US006876833B2

(12) United States Patent
Berg et al.

(10) Patent No.: US 6,876,833 B2
(45) Date of Patent: Apr. 5, 2005

(54) DEVICE AND METHOD FOR CLEANING AND FOR REGENERATING AN IMAGE CARRIER DURING ELECTROGRAPHIC PRINTING OR COPYING BY USING LIQUID INK

(75) Inventors: Martin Berg, Munich (DE); Martin Schleusener, Zorneding (DE); Volkhard Maess, Pliening (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 10/297,165

(22) PCT Filed: May 31, 2001

(86) PCT No.: PCT/EP01/06204

§ 371 (c)(1),
(2), (4) Date: Apr. 21, 2003

(87) PCT Pub. No.: WO01/92968

PCT Pub. Date: Dec. 6, 2001

(65) Prior Publication Data

US 2003/0170057 A1 Sep. 11, 2003

(30) Foreign Application Priority Data

May 31, 2000 (DE) ..... 100 27 203

(51) Int. Cl.[7] ..... G03G 21/00
(52) U.S. Cl. ..... 399/348
(58) Field of Search ..... 399/237, 239, 399/240, 343, 348, 350, 352, 353, 344, 368, 369; 15/256.5, 256.51

(56) References Cited

U.S. PATENT DOCUMENTS

| | | | | | |
|---|---|---|---|---|---|
| 3,910,697 | A | * | 10/1975 | Lanker | 430/125 |
| 4,268,597 | A | | 5/1981 | Klavan et al. | 430/102 |
| 4,796,048 | A | | 1/1989 | Bean | 399/308 |
| 4,982,692 | A | | 1/1991 | Uematsu | 118/661 |
| 5,576,822 | A | | 11/1996 | Lindblad et al. | 399/354 |
| 5,622,805 | A | | 4/1997 | Uehara et al. | 430/117 |
| 5,627,632 | A | * | 5/1997 | Staudenmayer et al. | 399/296 |
| 5,943,535 | A | | 8/1999 | Watanabe | 399/239 |
| 6,148,166 | A | * | 11/2000 | Watanabe | 399/239 |
| 2003/0175048 | A1 | * | 9/2003 | Berg et al. | 399/237 |

FOREIGN PATENT DOCUMENTS

| | | |
|---|---|---|
| DE | 1 902 034 | 9/1969 |
| DE | 20 55 993 | 12/1977 |
| DE | 20 53 812 | 2/1978 |
| DE | 35 35 025 | 4/1987 |

* cited by examiner

*Primary Examiner*—Hoan Tran
(74) *Attorney, Agent, or Firm*—Schiff Hardin LLP

(57) ABSTRACT

A device for cleaning an image carrier of residuals of an ink image, in which for inking the latent image on a latent image carrier, droplets are transferred from a liquid layer onto the surface of the latent image carrier by overcoming an air gap. The cleaning device is arranged at the circumference of the image carrier and removing the residual ink remaining after transfer of the image inked with a liquid ink is removed from the surface of the image carrier.

47 Claims, 17 Drawing Sheets

FIG. 20
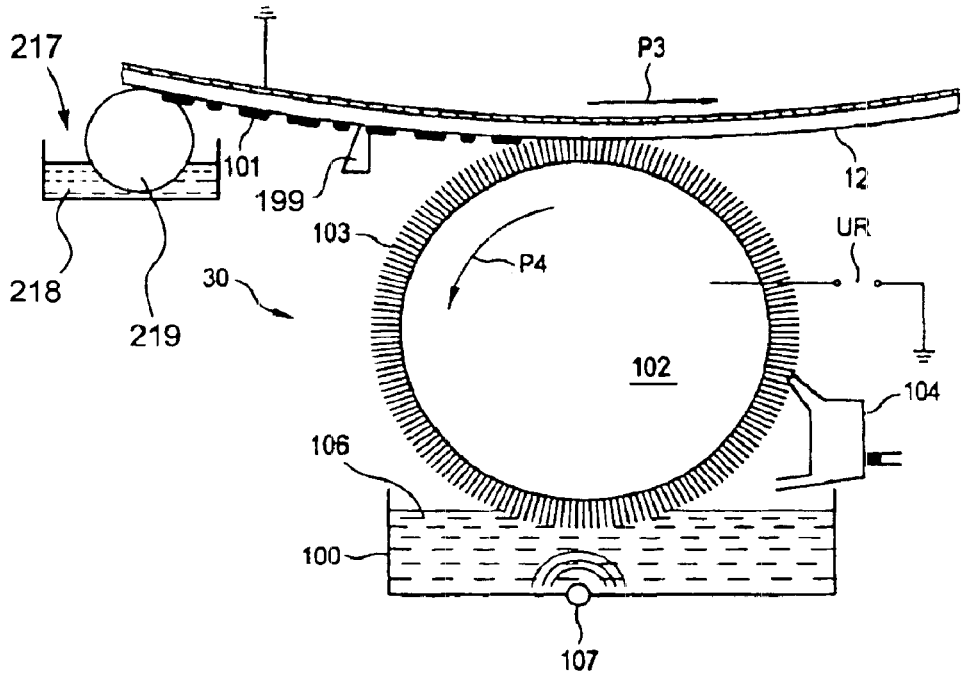
FIG. 20A
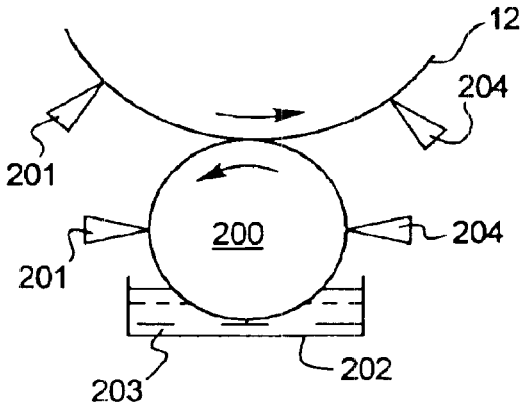
FIG. 20B
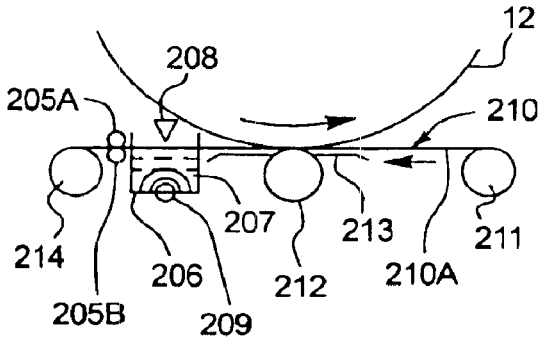
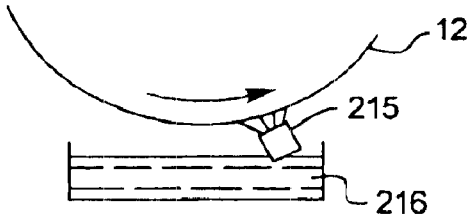
FIG. 20C

First Step

Second Step

DEVICE AND METHOD FOR CLEANING AND FOR REGENERATING AN IMAGE CARRIER DURING ELECTROGRAPHIC PRINTING OR COPYING BY USING LIQUID INK

RELATED APPLICATIONS

The present application is related to copending application of Martin Berg et al Ser. No. 10/297,228 filed Apr. 15, 2003 entitled "Device And Method For Electrographic Printing Or Copying By Using Liquid Ink"; and also copending application of Martin Berg et al Ser. No. 10/297,227 filed Apr. 15, 2003 entitled "Applicator Element and Method for Electrographic Printing or Copying by Using Liquid Ink.

BACKGROUND OF THE INVENTION

The invention relates to a device and a method for cleaning an image carrier of ink image remainders, in particular for cleaning during electrographic printing or copying by using liquid ink. Further, the invention relates to a device and a method for regenerating an image carrier, each of which is adapted to the use of liquid ink.

Known devices for electrographic printing or copying make use of a process in which dry toner is applied to the latent image of a latent image carrier, for example a photoconductor. Such dry toner results in relatively thick toner layers since the toner particles have a relatively large particle size and a plurality of toner particles have to be deposited on top of each other for achieving sufficient color coverage. The dry toner layer applied to the latent image has to be fixed, this requiring a relatively high energy. This high energy leads to a high stress on the final image carrier, preferably paper, as a result of the fixing by means of heat and/or pressure.

Liquid toners that have been used up to now contain a carrier liquid that is odorous and inflammable. Often, the final image carrier to which the liquid toner is applied is likewise odorous. When liquid toner is used, it is brought into contact with the latent image carrier.

U.S. Pat. No. 5,943,535 discloses the use of a water-based liquid toner that is brought into contact with the latent image carrier. Owing to the conductive liquid toner, a deposit corresponding to the electrostatic charge image is formed on the latent image carrier.

DE-A-30 00 019 discloses a device for a liquid developer. A latent image, for example a potential pattern, is generated on the final image carrier. An applicator element carries a liquid layer. An air gap having a predetermined air gap width is set between the liquid layer and the final image carrier. Liquid elements of the liquid layer are transferred onto the surface of the final image carrier due to its electric potential U.S. Pat. No. 4,982,692 discloses a method for printing that uses a liquid developer. Under effect of an electrostatic force field, droplets of a liquid layer on an applicator element are transferred onto the surface of a latent image carrier.

Further, U.S. Pat. No. 5,622,805 discloses a method using a liquid developer in which method droplets on an applicator roller are transferred onto the surface of a latent image carrier under influence of an electrostatic field.

Furthermore, reference has to be made to conventional printing methods, such as offset printing, which use liquid ink. With these conventional printing methods, the print form is not variable so that economical printing of small numbers of copies is not possible.

SUMMARY OF THE INVENTION

An object of the invention is to specify a device and a method for cleaning and/or regenerating an image carrier which allows the use of liquid ink.

This object is achieved by a device and method wherein for cleaning at least one of a latent image carrier and an intermediate carrier of an electrographic printer or copier of ink image remainders, a latent image carrier having a surface with a potential pattern corresponding to an image pattern to be printed is provided. An applicator element is provided with a liquid layer of ink. An air gap is provided between the liquid layer and the surface of the latent image carrier opposed thereto. For inking the latent image on the latent image carrier, droplets are transferred from the liquid ink layer onto the surface of the latent image carrier by overcoming the air gap. A cleaning station is arranged at a circumference of at least one of the latent image carrier and an intermediate carrier. With the cleaning station, residual ink remaining after transfer of the image is removed from the surface of at least one of the latent image carrier and the intermediate carrier.

Also, in another embodiment of the invention, a method and apparatus is provided for regenerating a surface of at least one of a latent image carrier and an intermediate carrier of an electrographic printer or copier. Defined surface properties are generated on the surface of at least one of the latent image carrier and the intermediate carrier a by a regeneration station arranged at a circumference of at least one of the latent image carrier and the intermediate carrier, such that the surface accepts and again gives off a liquid ink.

Embodiments of the invention are explained in the following with reference to the drawings.

BRIEF DESCRIPTION OF THE DRAWINGS

FIG. 20 illustrates an embodiment of a cleaning station and FIGS. 20A, 20B and 20C show alternate embodiments of a cleaning station.

DESCRIPTION OF THE PREFERRED EMBODIMENT

Figure 1:
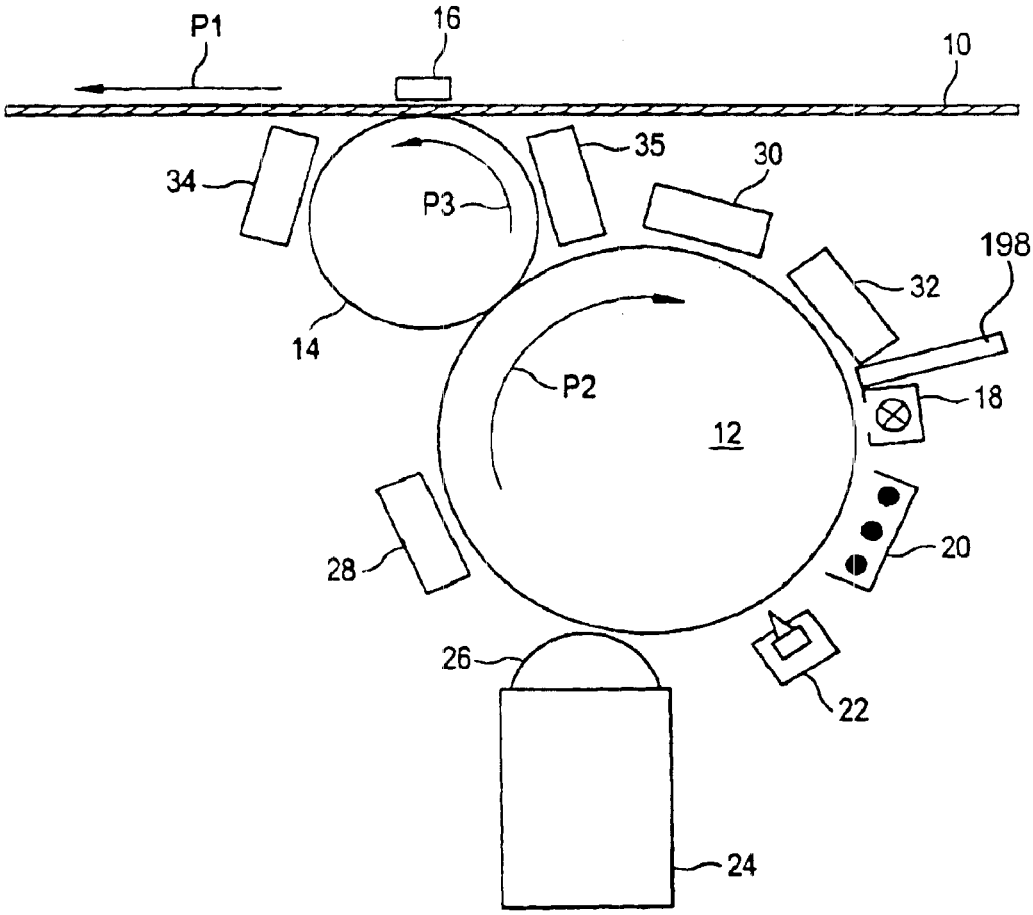
FIG. 1 schematically illustrates the structure of a printer device operating with liquid ink.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

The cleaning device is preferably used in a printer or copier. In this printer or copier, liquid ink is prepared in an inking station such that an amount of liquid that is constant per time and per area is present on an applicator element in the form of a liquid layer. On this applicator element, preferably a band or a roller, the liquid film is conveyed into the effective area of the potential pattern, the potential of which is distributed in accordance with an image pattern to be printed. Preferably, the potential pattern corresponds to an electrostatic charge image. The potential pattern was previously generated on the latent image carrier by suitable means, for example by means of electrostatic charging and exposing of a photoconductor. An air gap exists between the surface of the liquid layer and the latent image carrier with the potential pattern. Between the surface of the applicator element and the image locations of the potential pattern on the latent image carrier, there results a potential contrast, for example supported by the application of a voltage to the applicator element. Sections of the liquid layer are then partially separated from the applicator element and jump in the form of small droplets or transfer by means of a deformation of droplets in accordance with the field lines onto the surface of the latent image carrier and ink the latent image so as to form the ink image. Afterwards, this ink image can directly be transferred onto the final image carrier, for example paper. Another possibility is to first transfer the ink image from the latent image carrier onto an intermediate carrier and from there onto the final image carrier.

Liquid ink is used, preferably having a solid matter content of 20% or more. This liquid ink contains a carrier liquid that is preferably non-odorous, nonflammable, environmentally friendly and nontoxic. Preferably, water is used as a carrier liquid.

The use of a liquid ink has the advantage that it can easily be stored in a reservoir, that no segregation and no phase separation take place in the reservoir and the associated transport lines and that the ink does neither irreversibly dry onto the reservoir nor onto the associated transport lines. By means of the addition of a carrier liquid, the solid matter concentration or, respectively, the ink concentration can easily be varied. The liquid ink can be supplied such that an ink concentrate and the carrier liquid can be stored and transported separately from one another.

Owing to the injection of a defined excess charge into the droplets to be transferred during detachment of these droplets from the applicator element, an unintended background inking is avoided.

An air gap is present between the surface of the applicator element and the surface of the latent image carrier, said air gap being overcome by the liquid ink. This inking of the potential pattern on the latent image carrier across an air gap has the advantage that no wear takes place on the latent image carrier or, respectively, wear is at least minimized. When the droplets overcome the air gap, they are focused in accordance with the potential pattern, this resulting in a sharp line formation. The liquid ink image aligns itself automatically in accordance with the potential pattern, this particularly allowing a clear definition of the image edges.

The use of liquid ink further has the advantage that relatively thin ink layers can be generated on the final image carrier. In this way, the ink consumption is low and high printing speeds can be achieved. Advantages also result with regard to the fixing of the ink image on the final image carrier. The energy to be expended can be reduced and the processing speed can be increased.

The potential pattern on the latent image carrier is preferably formed as an electrostatic charge image. It is, however, also possible to generate a potential pattern in the form of magnetic field lines. In this case, the liquid ink should contain carrier particles that can be magnetically influenced and have the effect that ink is transferred onto the latent image carrier by overcoming the air gap and ink the latent image. The term "electrographic printing or copying" expresses that a plurality of electrically operating methods can be used with which a latent image can be generated on a latent image carrier.

According to a further aspect, a method is provided for cleaning an image carrier, in particular for the electrographic printing or copying.

According to another aspect, a device and a method are provided for regenerating an image carrier.

Conventionally, a regeneration of the surface of the latent image carrier, for example a photoconductor, takes place by erasing exposure and by the effects of the electric field of a discharge corotron. Regeneration with respect to the surface energy does not take place. The inventive regeneration station allows a regeneration of the surface of the latent image carrier with regard to maintenance of a defined surface energy.

With the aid of the before-mentioned inventive cleaning station and the inventive regeneration station, it is possible to realize a continuous cleaning in conjunction with the regeneration of the surface energy conditions of a surface bearing liquid ink. In addition, a regeneration of the charge carrier injection conditions of the surface of the latent image carrier takes place. The continuous cleaning in conjunction with the regeneration extends the working life of the image carrier, i.e. of a latent image carrier or an intermediate carrier. The regeneration of the latent image carrier and of a possibly following intermediate carrier can be coordinated such that there are always constant adhesion conditions at the point of contact. In this way, the transfer of the ink image is improved. Further, by means of the cleaning of the latent image carrier or, respectively, of the intermediate carrier, ink can be recovered and can be reused for further printing processes.

As one embodiment, FIG. 1 shows a printer device that prints a final image carrier 10, for example paper. The final image carrier 10 is moved in the direction of the arrow P1. The printer device comprises a photoconductor drum 12 that rotates in the direction of the arrow P2. An ink image applied to the photoconductor drum 12 is transferred onto an intermediate carrier drum 14, which is in contact with the photoconductor drum 12. The intermediate carrier drum 14 rotates in the direction of the arrow P3 and transfers, supported by a corotron 16, the ink image onto the lower side of the final image carrier 10.

At the circumference of the photoconductor drum 12, there are arranged an exposure station 18, a corotron 20, a light source 22 for generating a latent image on the photoconductor drum 12, an inking station 24 with an applicator roller 26, a hot air generator 28, a cleaning station 30 and a regeneration station 32. A drying station 198 may follow the regeneration station 32. The functions of these units 18 through 32 will be explained in more detail below.

At the circumference of the intermediate carrier drum 14, there are arranged a further cleaning station 34 and a hot air station 35. The further cleaning station 34 can have the same structure as the cleaning station 30.

Figure 2:
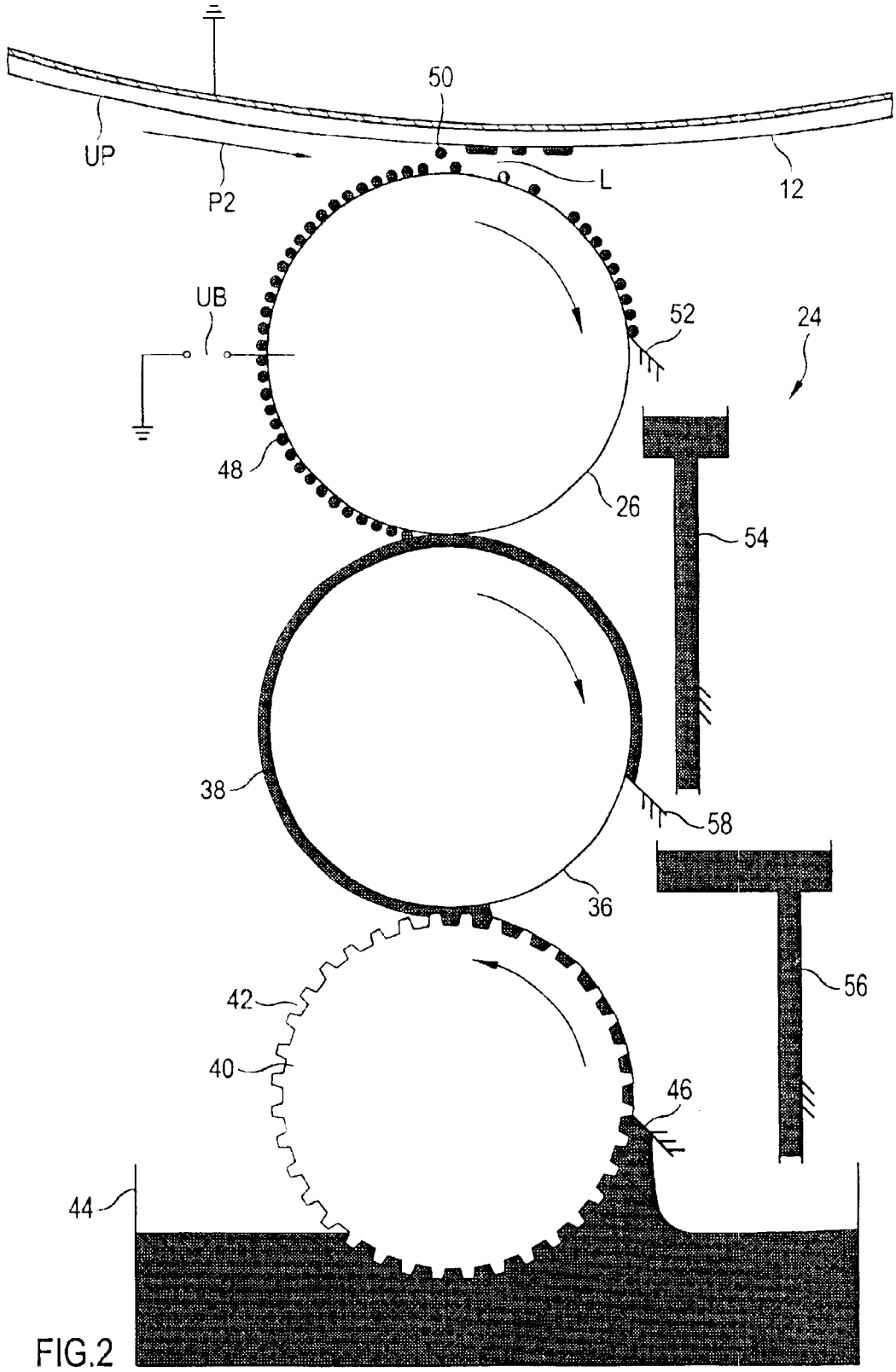
FIG. 2 shows an inking station comprising an applicator roller for the provision of a thin liquid layer.

FIG. 2 shows an exemplary embodiment of the inking station 24 with the applicator roller 26, which is opposite the surface of the photoconductor drum 12. By means of a feed roller 36, a uniform liquid film 38 is supplied to the applicator roller 26. An amount of ink that is constant over time is, in turn supplied to this feed roller 36 via a scoop roller 40, which has a structure with cups 42 on its outer circumference. The scoop roller 40 dips with a portion thereof into a scoop tank 44, in which a supply of ink is contained.

A doctor blade 46 acts at the outer circumference of the scoop roller 40, said doctor blade 46 having the effect that only the volume of ink that is contained in the cups 42 is conveyed. The feed roller 36 is deformable. The cups 42 empty themselves on the surface of the feed roller so that the smooth liquid film 38 is formed thereon. This liquid film 38 is brought to the applicator roller 26.

The feed roller 36 can rotate in the same or in opposite direction with regard to the applicator roller 26. Preferably, the applicator roller 26 and the feed roller 36 rotate in the same direction, as shown in FIG. 2 by the rotational direction arrows. From the smooth liquid film 38, the applicator roller 26 separates a homogeneous droplet carpet or droplet cover 48, the droplets of which, under the effect of an electric field, jump from the surface of the applicator roller 26 onto the photoconductor 12 in accordance with the image pattern, as shown, for example, with reference to the droplet 50 in FIG. 2. In doing so, the droplet 50 overcomes an air gap L, which lies in the range of 50 to 1000 $\mu$m, preferably in the range of 100 to 200 $\mu$m. The surface of the photoconductor 12 can move in the same or in the opposite direction as the surface of the applicator roller 26. The surface speed of these two elements can be the same or different from one another. Preferably, the surfaces of the photoconductor 12 and of the applicator roller 26 move at the same speed in the same direction, as illustrated in FIG. 2. The remainders of the droplet cover 48 are removed from the surface of the applicator roller 26 by means of a doctor blade 52 and are re-supplied to the ink in the scoop tank 44 via a conduit system 54, 56. A further doctor blade 58 removes the liquid film 38 on the feed roller 36 and supplies the remainders to the ink in the tank 44 via the element 56.

For supporting the transfer of the droplets 50 from the surface of the applicator roller 26 onto the surface of the photoconductor 12, a bias potential UB in the form of a direct voltage is applied to the applicator roller 26. Due to this bias potential UB, there results a potential contrast between image locations on the photoconductor 12 and the bias potential UB. In addition, an alternating voltage having a frequency of preferably 5 kHz or more can be superimposed on the bias potential UB.

The potential pattern on the photoconductor 12 is referenced UP. This potential pattern UP is generated as a charge image for example with the aid of a conventional electrographic process by means of charging with a corotron 20 (see FIG. 1) and by means of partial discharge with the aid of a light source 22, for example an LED print head or a laser print head.

At the image locations of the surface of the photoconductor 12 that are defined by the potential pattern UP, there results a charge transfer within the liquid droplets in the droplet covering 48 due to the difference in potential and as a consequence thereof there results a detachment of droplets, for example of the droplet 50. Moreover, during the detachment an excess charge is injected into the droplet. As a result of the effect of the electric field and the kinetic impulse or kinetic momentum, the droplet 50 moves towards the photoconductor surface and, by means of the field lines, is focused onto the image locations that are to be developed.

Alternative embodiments of an inking station can comprise an anilox roller with a chamber doctor blade as scoop roller. Another alternative provides that a smooth liquid film is sprayed onto the feed roller. A further alternative embodiment provides that the applicator roller dips with one portion thereof into a bath with ink and that the dosage of the accepted amount of liquid is effected via an elastic roll doctor that acts on the surface of the applicator roller. Further alternative embodiments of the inking station will be explained further below.

Figure 3:
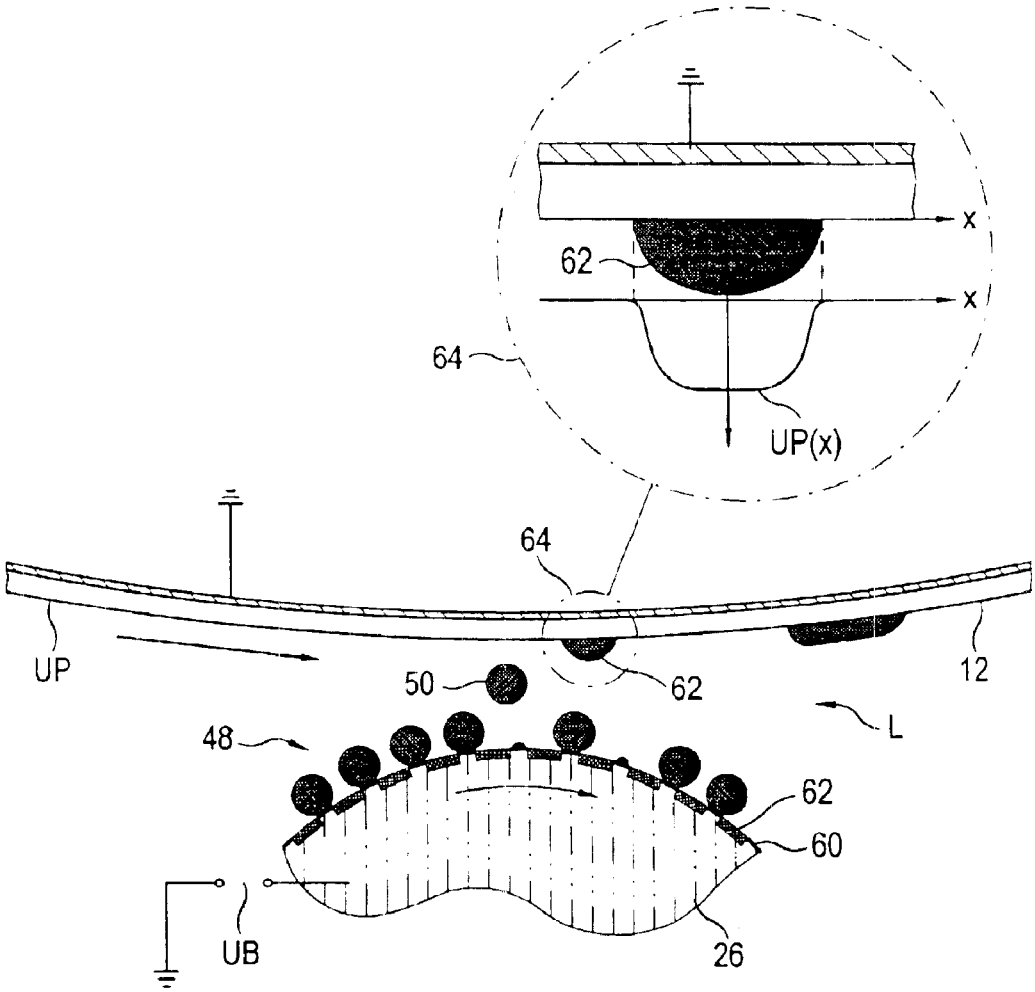
FIG. 3 shows the principle of the transfer of droplets from the liquid layer present on the applicator element onto the surface of the latent image carrier.

FIG. 3 shows further details within the region of the air gap L between the surface of the photoconductor drum 12 and the surface of the applicator roller 26. In this example, the surface of the applicator roller 26 has a uniform structure with elevations 60 having a height of about 5 to 10 $\mu$m and a distance from one another of about 10 to 15 $\mu$m. These elevations 60 have a higher surface energy and a lower specific resistance than the area portions 62 surrounding them. The surface energy of the elevations 60 preferably lies in the range of 40 mN/m, the specific resistance lies preferably in the range of $10^1$ to $_{106}$ Ωm. Preferably, the area portions 62 have a surface energy in the range of less than 20 mN/m and a specific resistance of preferably greater than $10^7$ Ωcm. The droplets of the droplet cover 48 shown in FIG. 3 form on the elevations 60. After the transfer of the droplets onto the surface of the photoconductor 12 as a result of electric field forces of the potential pattern UP, the droplets, for example the droplet 62, deposit, corresponding to the potential UP, along the distance x, as shown more precisely in the detail 64.

Figure 4:
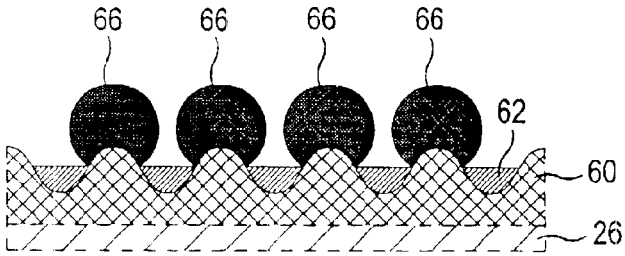
FIG. 4 is an example of the structure of the surface of the applicator element, a droplet cover forming on the surface.

FIG. 4 illustrates by way of example a detail of the surface of the applicator roller 26 with the elevations 60 and the area portions 62. The droplets 66 form on the elevations 60. These droplets are of a size of about 0.3 to 50 $\mu$m in diameter. The droplets 66 have a relatively low adhesion and obtain an increased electric excess charge on the surface under the influence of an outer electric field (not shown). Such an outer electric field is, for example, generated by the image locations that are defined by the charge image, are to be inked with ink and are located in the proximity of the elevations 60 during inking, for example at a distance L according to FIG. 2. The detachment under the effect of a latent charge image is thus facilitated. The droplet size can be varied by varying the structure size of the surface structure. The droplet size is equal to or smaller than the print resolution, preferably the droplet diameter amounting to about a quarter of the smallest picture element to be printed.

Figure 5:
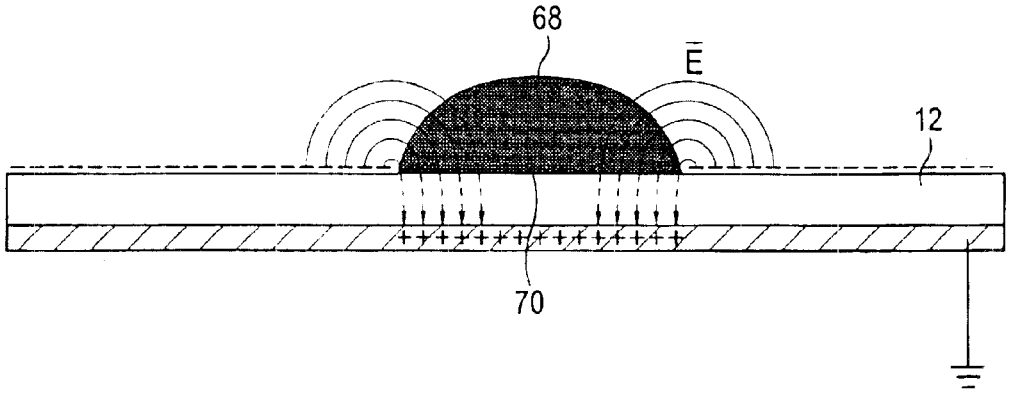
FIG. 5 shows the alignment of the liquid ink on the surface of the latent image carrier in accordance with a charge image.

FIG. 5 shows the distribution of the droplet or of a plurality of droplets transferred onto the photoconductor 12 in accordance with the charge image and the field strength E. In this example, the picture element 70 to be inked with ink is defined by the negative charges on the surface of the photoconductor 12. The ink 68 in the form of a droplet or a plurality of droplets transferred onto this image location 70 aligns itself in accordance with the charge image, in particular image edges are sharply defined. The surface energies of the photoconductor 12 and of the liquid ink 68 are coordinated such that a contact angle of greater than about 40° results.

Figure 6:
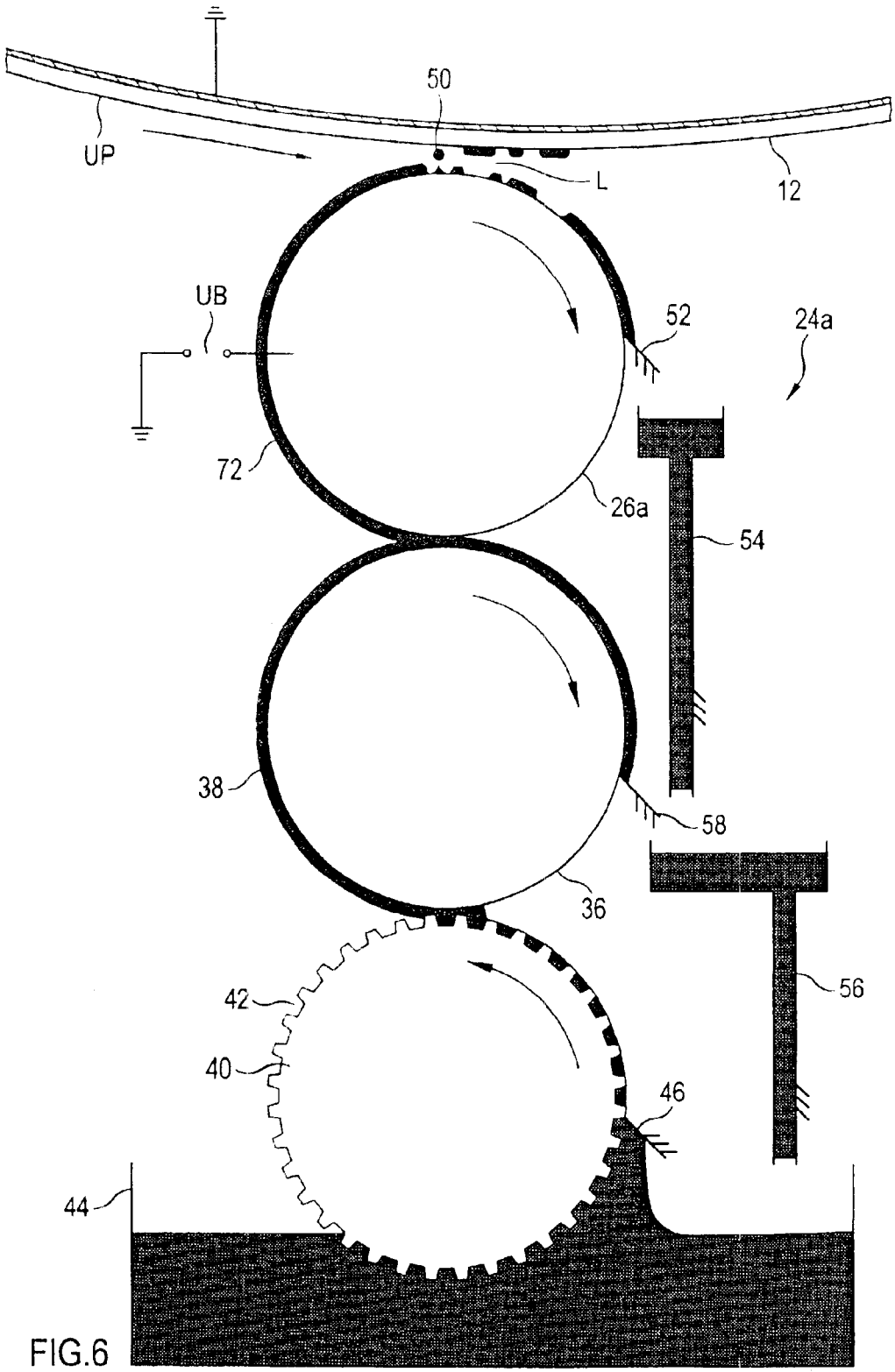
FIG. 6 shows an alternative embodiment of an inking station.

FIG. 6 shows a further alternative of an inking station 24. In this case, due to continuous homogeneous surface properties, the applicator roller 26*a* does not bear a droplet cover, but rather a continuous ink layer 72. The surface energy of the surface of this applicator roller 26*a* typically lies in the range of 10 to 60 mN/m, preferably between 30 and 50 mN/m. The specific resistance of the surface lies in the range of $10^2$ to $10^8$ Ωcm, preferably between $10^5$ and $10^7$ Ωcm. A smooth liquid film having a thickness in the range of 5 to 50 μm, preferably 15 μm, is generated on the applicator roller 26*a*. This liquid film 72 is brought into the effective area of the potential pattern UP. Due to the potential contrast, there results a charge transfer within the liquid layer at the image locations defined by the charge image and as a result thereof droplets are formed and detached, as shown for example with reference to the droplet 50. Moreover, during detachment an excess charge is injected into the droplet 50, in a way similar to the one discussed with reference to FIG. 5. Due to field effect and the kinetic impulse, the droplet 50 moves to the surface of the photoconductor 12 and is focused, by means of the field lines, onto the image areas to be developed. The further structure of the inking station 24*a* corresponds to the inking station 24 shown in FIG. 2.

Figure 7:
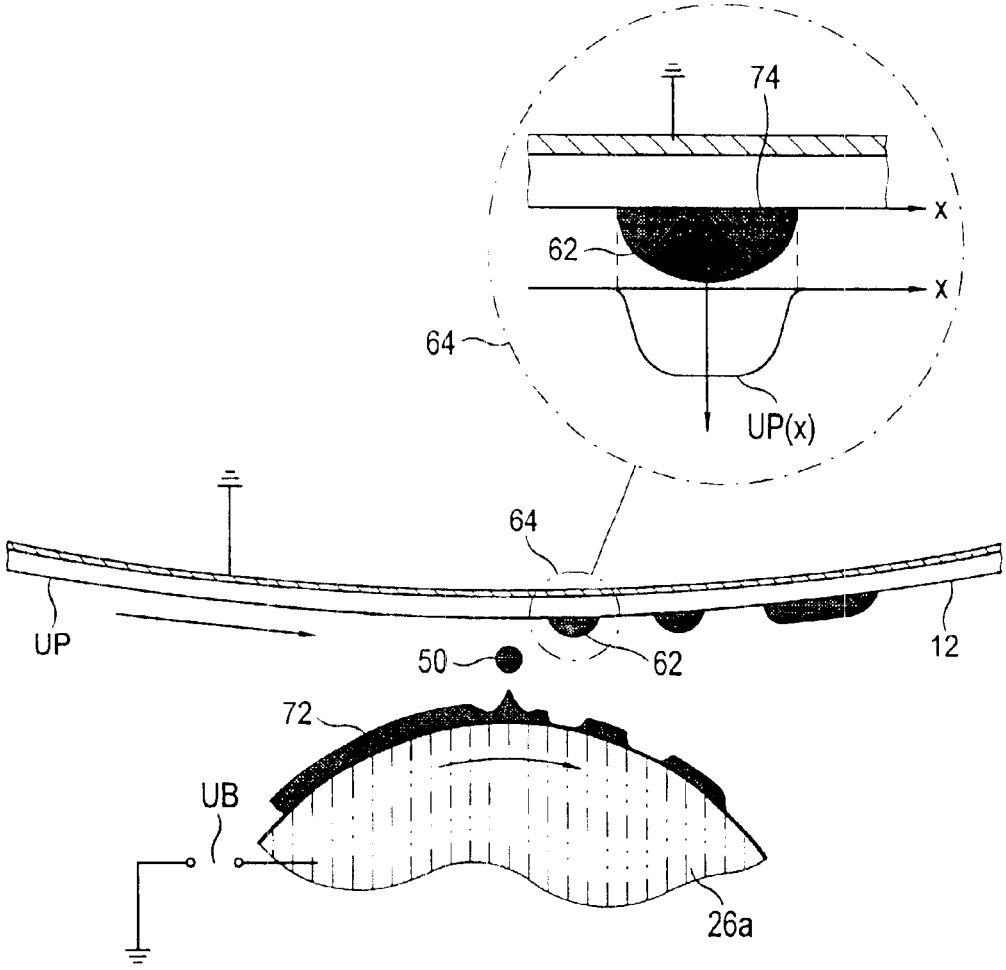
FIG. 7 shows the surface of an applicator roller with continuous properties and the formation of a uniform liquid layer.

FIG. 7 is an illustration similar to FIG. 3, however with the use of the smooth homogeneous liquid film 72, from which droplets 50 are detached in accordance with the distribution of the potential pattern UP. Here, too, a plurality of droplets collects on the image location 74 in order to ink this image location. Due to the potential pattern UP(x) present in the abscissa direction x, there results a focusing of the ink onto the image locations 74 that are to be developed. Due to the interaction between the electric field strength, the surface tension and the micro charge distribution on the ink 62, the liquid ink 62 aligns itself on the photoconductor 12 with respect to the edges of the field strength, as a result whereof the edges of the picture elements are smoothed. The surface of the photoconductor 12 should have a surface energy that does not cause a complete spreading of the liquid ink 62, i.e. a spreading of the ink is avoided.

In FIG. 3 or 7, it is shown that the droplets jump from the surface of the applicator roller 26 or 26*a* to the opposing surface of the photoconductor 12. Such a jumping does not necessarily have to be present. A droplet of the droplet cover 48 on the applicator roller 26 or a droplet on the applicator roller 26*a* forming from the smooth liquid film 72 can be longitudinally deformed as a result of the electric field effect according to the potential pattern UP. This deformation of the droplet can be such that for a short period of time a liquid channel is formed between the surface of the photoconductor 12 and the surface of the applicator roller 26 or 26*a*, and the droplet can, at the same time, be in contact with the surface of the photoconductor as well as with the surface of the applicator roller 26 or 26*a*. As a result of the present surface forces, the droplet then migrates completely or partially from the surface of the applicator roller 26 or 26*a* towards the surface of the photoconductor, thereby causing an image-wise inking.

In the following FIGS. 8 through 19, the structure and technical properties of the surface of the applicator roller 26 are explained. In principle, the applicator element, independent of its shape, is characterized in that its surface has a structure with a plurality of areas at which the detachment of droplets from the liquid layer is facilitated. This liquid layer can be present in the form of a homogeneous uniform layer or as a droplet cover, as already mentioned further above.

Figure 8:
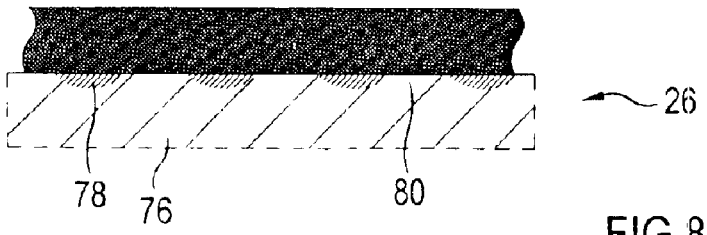
FIG. 8 shows a cover layer of an applicator roller with first areas of increased electrical conductivity.

The applicator roller 26 of FIG. 8 has a cover layer 76 with reduced conductivity and a surface energy in the range of preferably 30 to 50 mN/m with a relatively small polar portion of the surface energy, preferably in the range of less than 10 mN/m. Embedded in this cover layer 76 is a plurality of first areas 78 which has an increased electrical conductivity compared to the cover layer 76. The first areas 78 are, for example, generated by doping the cover layer 76 with metal atoms. The first areas 78 can repeat at regular intervals or can be arranged at intervals that are stochastically distributed. Preferably, the intervals of the first areas 78 have a distance from one another of 0.3 to 50 μm.

In the areas 80 left vacant from the first areas 78, the surface energy is increased so that there is the tendency to form droplets. The cover layer can, for example, be made of the material DLC (diamond like carbon). The doping of the first areas 78 can be selected such that an almost rectangular transition of the conductivity is present. Alternatively, a soft, continuous transition can likewise be selected. The type of the transition and also the size of the first areas 78 and the vacant areas 80 define the size of the droplets. In this way, droplets can be generated that have a diameter of up to 10 μm at a maximum and can easily be detached from the areas 80.

The advantage of the arrangement shown in FIG. 8 is that the structuring of the cover layer 76 with areas 78 of different conductivity can be effected at an otherwise smooth surface. At the first areas 78 of increased conductivity, an injection of charge carriers into the ink droplets can take place, which charge carriers support the detachment of the droplets from a closed liquid film under the influence of an outer electric field.

Figure 9:
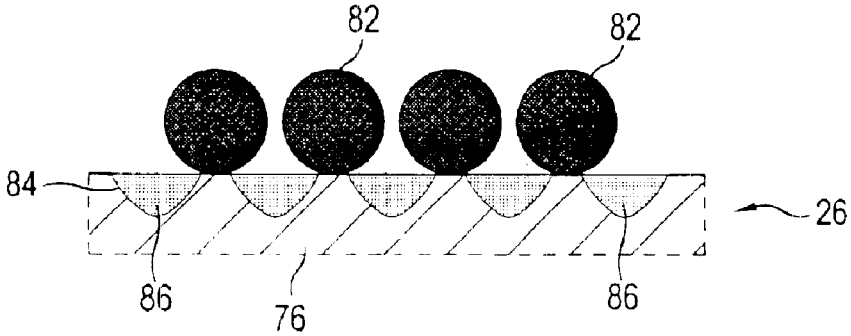
FIG. 9 shows a cover layer of an applicator roller with second areas of varied surface energy.

FIG. 9 shows a further alternative of the structuring of the surface of the applicator roller 26. The same reference signs refer to the same elements and this is also maintained for the following figures. In the embodiment according to FIG. 9, a structuring takes place by varying the surface energy section-wise. This variation in surface energy takes place in a fixed raster and abruptly. In an alternative, the transition between sections of different surface energy can be continuous and the raster can be stochastically distributed. Formed in the cover layer 76 of a first material are cups 84, the raster-like distribution of which takes place with a resolution of preferably 1200 dpi. The cups 84 are filled with a second material. The cups 84 with the second material form second areas 86 in the surface of the cover layer 76 with vacant areas 80 lying in between. A droplet cover with droplets 82 forms at these vacant areas.

The combination of two materials allows for multiple alternatives. For example, ceramics can be provided as a first material and Teflon as a second material. Further, as a first material, DLC material, F-DLC material (fluor diamond like carbon material) or SICON material can be provided and Teflon as a second material. A further material combination results, when an Ni layer or a layer made of an Ni alloy, preferably CrNi, is provided as a first material and Teflon is provided as a second material, the Teflon material preferably being embedded in the Ni layer in the form of pellets.

The advantages of the arrangement according to FIG. 9 are that the structuring can be effected on an otherwise smooth surface. The change in surface energy specifically results in a promotion of the droplet formation. An adaptation to various ink systems is possible due to the numerous alternatives of material combinations. The combination of materials further allows for a decrease in adherence of the formed droplets on the surface of the applicator roller.

Figure 10:
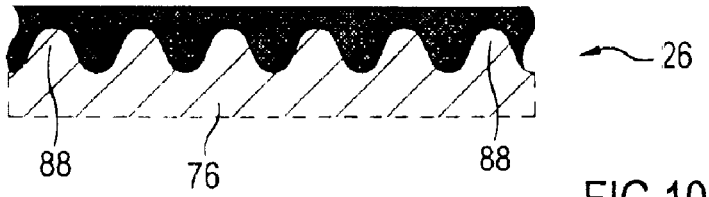
FIG. 10 shows a cover layer of an applicator roller with third areas of microscopic elevations.

FIG. 10 shows a further example for a structuring of the surface of the applicator roller 26 such that the formation and the detachment of the droplets from the liquid layer are facilitated. The structure of the surface has a plurality of third areas 88 that are formed as microscopic elevations on the otherwise macroscopically smooth surface. These third areas 88 can form a regular or a stochastic structure. Preferably, the local wave length of this structure lies in the range of 0.3 to 50 $\mu$m. The material of the cover layer should be such that it forms a contact angle as large as possible with the used liquid ink, preferably a contact angle of larger than 90°. Thus, a discontinuous liquid layer forms, preferably in the form of droplets, at the contact surface between liquid and the surface of the applicator roller 26. The microscopic elevations form small peaks and edges that, in the effective area of an electric field, result in the formation of electric field peaks. These field peaks serve as detachment locations for droplet transfer.

Figure 11:
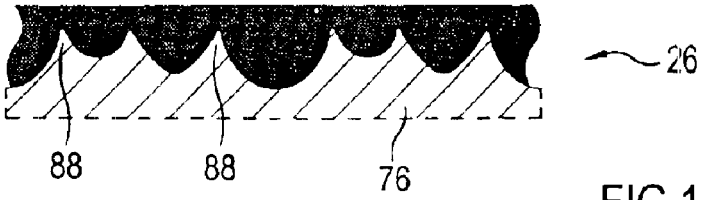
FIG. 11 shows stochastically distributed microscopic elevations.

FIG. 11 shows that the third areas 88 can be stochastically distributed. The difference in height between the highest points of the microscopic elevations of the third areas 88 and the plane of the macroscopically smooth surface amounts to approximately 2 to 20 $\mu$m, and preferably 5 to 10 $\mu$m for the examples according to FIGS. 10 and 11.

Figure 12:
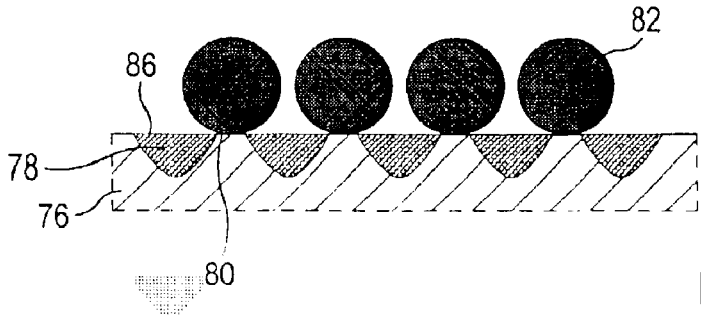
FIG. 12 shows a cover layer with a combination of first and second areas.

FIG. 12 shows an example in which first areas 78 and second areas 86 are combined with one another. Both areas 78, 86 are formed at the same locations. Alternatively, the transition between the combined first and second areas 78, 86 and the remaining areas 80 can be continuous and the areas can be stochastically distributed. The combination of materials can be such as explained in connection with FIG. 9.

Figure 13:
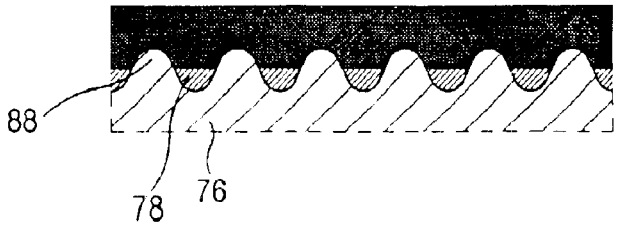
FIG. 13 shows a combination of first and third areas.

FIG. 13 shows a surface structure as a combination of the examples according to FIGS. 8 and 10. First areas 78 with increased conductivity are combined with a change in the surface contour. The first areas 78 and the third areas 88 can be formed regularly and alternately. The local wave length of the first areas 78 and the third areas 88, however, can also differ from one another, the local wave length of the third areas 88 being at most one fifth of the local wave length of the first areas 78. As a result of the combination of the first areas 78 and the third areas 88, the droplet formation, the size of the droplets and the injection of charge carriers into these droplets can be influenced.

Figure 14:
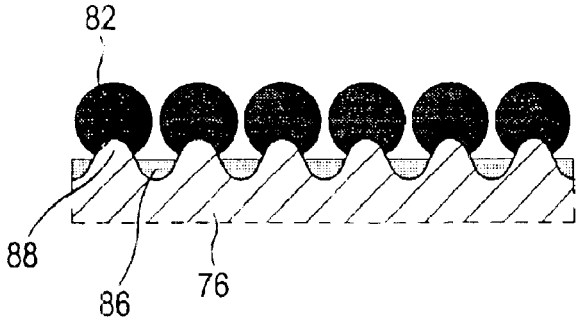
FIG. 14 shows a cover layer of an applicator roller on which second and third areas are combined with one another.

FIG. 14 illustrates an embodiment in which the surface is structured such that second areas 86 and third areas 88 are combined with one another. These second areas 86 and third areas 88 can be formed regularly and alternately. Alternatively, the local wave lengths of the second areas 86 and of the third areas 88 can be different from one another, the local wave length of the third areas 88 being at most one fifth of the local wave length of the second areas 86.

Figure 15:
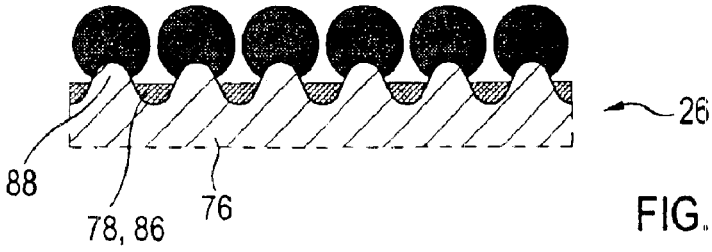
FIG. 15 shows a cover layer in which first areas, second areas and third areas are combined with one another.

FIG. 15 shows a further embodiment in which first areas 78, second areas 86 and third areas 88 are combined with one another. In this way, the wetting of the surface of the applicator roller 26 can specifically be adjusted.

Figure 16:
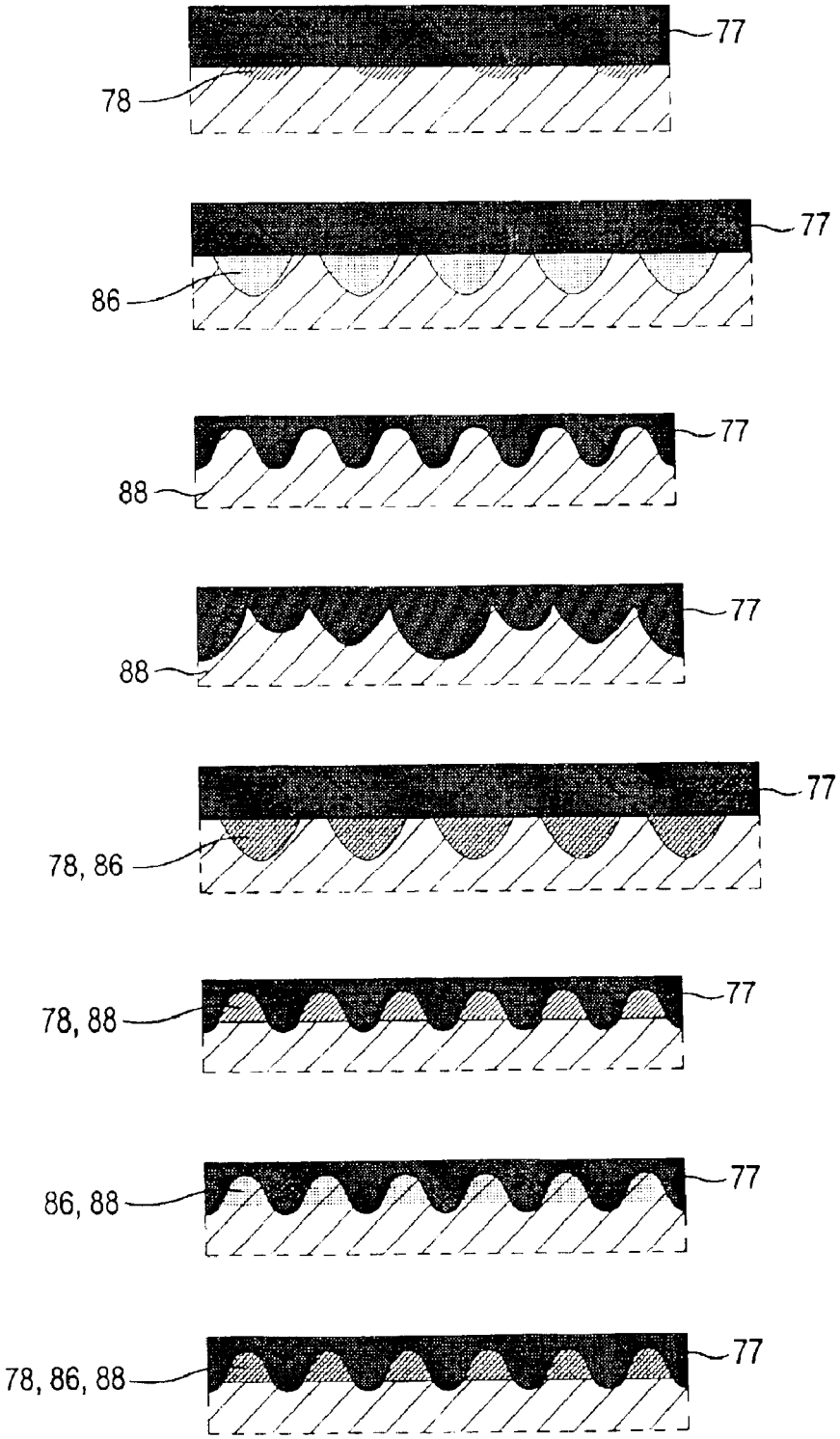
FIG. 16 is an overall view of possible surface structures and their combinations.

FIG. 16 is an overall view of the possible surface structures and their combinations. In the uppermost illustration, it is shown that the cover layer of the applicator roller has first areas 78 with a varied conductivity. In the example according to FIG. 16, the liquid ink is shown in as a continuous layer 77.

The next example shows the second areas 86 that have the form of cups and have a varied surface energy. The next example shows the surface structure with the third areas of a microscopic regular surface contour. The next example shows a stochastically distributed surface contour with third areas 88. The further example shows a surface structure with a combination of first areas 78 and second areas 86. The further example shows a combination of first areas 78 of varied conductivity and third areas 88 with a microscopic surface contour. Another example shows the combination of second areas 86 and third areas 88. The last example shows a surface structure with a combination of first areas 78, second areas 86 and third areas 88.

Figure 17:
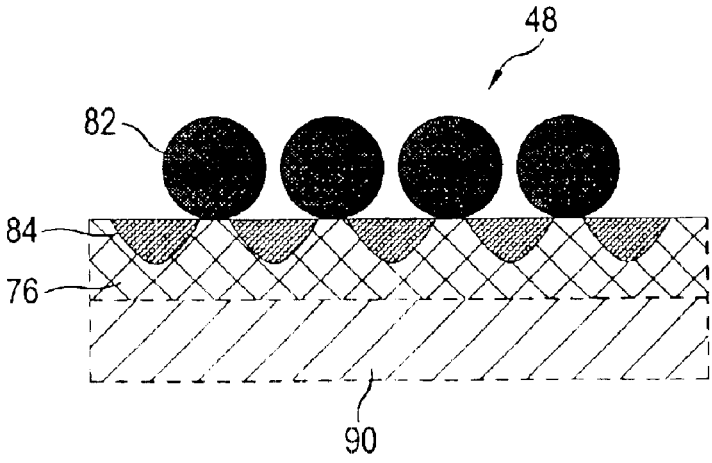
FIG. 17 shows the surface structure of an applicator roller having a uniform cup structure.
Figure 18:
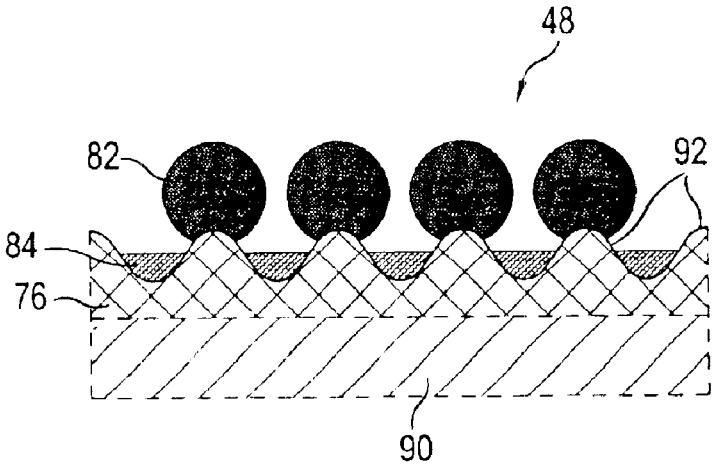
FIG. 18 shows an applicator roller surface having a cup structure and elevated islands.
Figure 19:
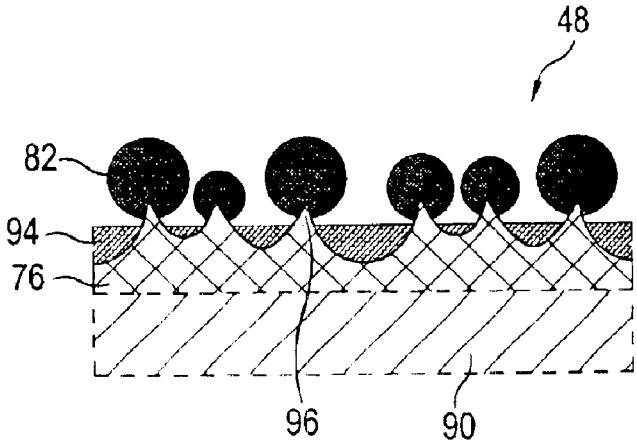
FIG. 19 shows a surface structure with a stochastic distribution of cups and with uncovered peaks of microscopic elevations.

FIGS. 17 to 19 illustrate concrete surface structures for an applicator roller. According to FIG. 17, a cover layer 76 with reduced conductivity and a surface energy in the range of 30 to 50 mN/m with a polar portion of greater than 5 mN/m, for example ceramics, is applied onto a metallic basic body 90. This cover layer 76 has a regular cup structure, for example with a resolution of 1200 dpi. The cups 84 are filled with a material having a surface energy that is lower than that of ceramics and a conductivity that is lower than that of ceramics, for example Teflon. Altogether, there results a planar roller surface. The surface of the filled cups covers a portion of 60 to 90%, preferably 70 to 80%, of the entire surface. At the contact point between feed roller 36 and applicator roller 26 (see FIG. 2), the liquid film 38 is split. On the applicator roller 26, only those areas of the surface which have an increased surface energy will accept liquid. Since these areas with increased surface energy are separated from areas with reduced surface energy, there results the formation of a uniform droplet cover 48. The droplet size is determined by the fineness of the structure of hydrophobic and hydrophilic areas. With a resolution of 1200 dpi, droplets of approximately 10 to 15 $\mu$m in diameter form.

FIG. 18 illustrates a further example for the structuring of the surface of the applicator roller. A cover layer 76 with reduced conductivity, for example, ceramics, and having a thickness of 1 to 500 $\mu$m is applied onto the metallic basic body 90 having a surface energy in the range of preferably 30 to 50 mN/m with a polar portion of greater than zero. The basic body 90 or, optionally, the cover layer 76 is structured by a regular cup structure with a resolution of at least 1200 dpi. The cups 84 are filled with a material having a surface energy that is lower than ceramics and a conductivity that is lower than ceramics, for example Teflon. The cups 84 are not completely filled so that a roller surface with elevated islands 92 forms. The surface of the filled cups covers a portion of 60 to 90% of the entire surface. On the elevated locations 92, droplets 82 form a droplet cover 48 upon contact with the feed roller 36.

FIG. 19 shows a further embodiment of an applicator roller. Optionally, an intermediate layer 76 with reduced conductivity and a surface energy in the same range, for example ceramics, and having a thickness in the range of 1 to 500 $\mu$m is applied onto the conductive basic body 90, preferably made of metal, with a surface energy in the range of 30 to 50 mN/m with a polar portion of greater than or equal to 5 mN/m. The surface of the roller basic body 90 or, optionally, the intermediate layer 76 is structured by a stochastic distribution of cups 84 in the raster distance of 0.3 $\mu$m to 50 $\mu$m, preferably in the range of 0.3 $\mu$m to 20 $\mu$m. A cover layer 94, for example made of Teflon, of a material having a surface energy and a conductivity that are lower than those of the layer 76, 90 lying underneath fills the depressions so that the peaks 96 of the stochastic surface structure remain uncovered. The size of the surface of the filled depressions preferably amounts to 60 to 90% of the entire surface. On the uncovered peaks 96, droplets 82 form a droplet cover 48 upon contact with the feed roller 36.

In the following, further units of the printer device shown in FIG. 1 are described. After inking the latent image on the photoconductor drum 12, there results a thickening of the ink image due to physical and/or chemical processes, preferably due to the evaporation of the carrier liquid in the ink. This effect is increased by the hot air generator 28, to which the inked ink image is supplied as a result of the rotary motion of the photoconductor drum 12. In the illustrated example according to FIG. 1, the ink image is first transferred from the surface of the photoconductor drum 12 onto the surface of an intermediate carrier drum 14 that is in contact with the surface of the photoconductor drum 12. The transfer takes place by means of mechanical contact and is preferably supported by a transfer voltage that is applied to the intermediate carrier drum 14. During transfer of the ink image, the layer thickness of this ink image is made uniform and there results a smoothing. The intermediate carrier drum 14 is composed of a highly electrically conductive body, preferably made of metal, and has a coating with a defined electrical resistance, preferably in the range of $10^5$ to $10^{13}$ $\Omega$cm.

Instead of the intermediate carrier drum 14, a band can alternatively be provided as an intermediate carrier, the band having a defined electrical resistance, preferably in the range of $10^5$ to $10^{13}$ $\Omega$cm and being advanced to the inked image on the latent image carrier, for example the photoconductor drum 12, by a highly electrically conductive element which is preferably made of a metal. This band, too, preferably carries an electric potential on the surface, which potential supports the transfer of the liquid image from the latent image carrier to the intermediate carrier. The electric potential of the surface of the intermediate carrier is set by an auxiliary voltage, which is directly applied to the intermediate carrier or to the highly electrically conductive element, which advances the intermediate carrier surface to the inked image on the latent image carrier. This auxiliary voltage can include direct voltage components and alternating voltage components.

At the point of transfer from the latent image carrier to the intermediate carrier, for example the intermediate carrier drum 14, there results the following relationship with respect to the adhesive forces: the cohesion of the ink image is greater than the adhesion between the intermediate carrier and the ink image; the adhesion between the intermediate carrier and the ink image is in turn greater than the adhesion between the surface of the latent image carrier and the ink image. Due to these relations of adhesive forces, the ink image is transferred from the latent image carrier onto the intermediate carrier.

At the intermediate carrier, the viscosity of the transferred ink image can be further increased by suitable means, preferably by a dry hot air stream. In this way, it is guaranteed that the cohesion of the ink image is sufficiently high to ensure a complete transfer onto the final image carrier 10. Further, it is ensured that in the operating mode "collecting mode", which will be explained in more detail further below, each ink image that has been generated last has a lower cohesion than the respective previously collected ink images. In this way, a back transfer of ink onto the surface of the photoconductor is avoided.

According to FIG. 1, a hot air station 35 is provided for the generation of a dry hot air stream that acts on the surface of the intermediate carrier drum 14. The surface of the intermediate carrier drum 14 is guided past this hot air station in the direction of rotation P3.

A cleaning station 30 or a cleaning station 34 is arranged at the circumference of the photoconductor drum 12 or of the intermediate carrier drum 14. These cleaning stations 30, 34 serve to remove the remainders of the ink image that is still left after transfer printing. The structure of the cleaning station 30 or 34 will be explained in more detail further below. Further, following the cleaning station 30, a regeneration station 32 is arranged at the circumference of the photoconductor drum 12, the regeneration station generating defined surface properties and charge injection conditions on the surface of the photoconductor drum 12.

For the realization of a multicolor print on the final image carrier 10, various operating modes can be provided. In a first operating mode, various color image separations are generated successively on the latent image carrier, i.e. the photoconductor drum 12, and are successively transferred directly onto the final image carrier 10.

In a second operating mode, several color image separations are superimposed on the photoconductor 12. The superimposed color image separations are then transferred jointly onto the final image carrier 10.

A third operating mode provides that for the realization of a multicolor print, several color image separations are generated successively on the latent image carrier and are superimposed on the intermediate carrier. The superimposed color image separations are jointly transferred from the intermediate carrier onto the final image carrier 10.

In a fourth operating mode, a printing unit comprising a latent image carrier and an applicator element is provided for each color image separation, said printing units each generating a color separation. The various color separations are successively transferred with register accuracy directly onto the final image carrier 10 or first onto an intermediate carrier, e.g. the intermediate carrier drum 14, and are transferred from there onto the final image carrier 10. This operating mode is also referred to as single pass method.

A fifth operating mode is characterized in that for the realization of a multicolor print, a single latent image carrier is provided to which a plurality of applicator elements, for example of the type of the applicator roller 26, is allocated. Each applicator element generates a color image separation that is transferred directly onto the final image carrier 10 or first onto an intermediate carrier and from there onto the final image carrier 10. This operating mode is also referred to as multi-pass method.

An embodiment of the single pass method presents up to five complete printing units, each having a character generator, a latent image carrier and at least one inking station, and has one joint intermediate carrier. The multi-colored image is generated in a single pass. For this purpose, the individual partial color images are generated on the latent image carriers allocated to them with such a temporal distance that they hit the same surface area of the intermediate carrier with register accuracy, which intermediate carrier is successively moved past the individual inked latent image carriers and, in contact with those, accepts the partial color images. As a result of the superposition on the intermediate carrier, the partial color images jointly form the mixed color image. The cohesion of the individual ink images is set on the respective latent image carrier such that the cohesion of the ink image that has first been transferred onto the intermediate carrier is higher than that of each following ink image. This can, for example, be achieved by a respectively differently progressed dried state of the ink images.

FIG. 20 illustrates an embodiment of the cleaning station 30. This cleaning station 30 has the function of removing the remainders 101 of the ink image still left after transfer printing of the ink image from the surface of the photoconductor drum 12. In the illustrated example, a brush roller 102 is used for this purpose, the brush 103 of which is in contact with the surface of the photoconductor drum 12. The brush roller 102 rotates in the direction of the arrow of rotation P4 preferably in opposite direction to the movement of the photoconductor drum 12 in the direction P3. The brush 103 is arranged such that the theoretical outer diameter of the brush roller 102 reaches into the surface of the photoconductor drum 12. This guarantees the defined stress on the bristles and the compensation of manufacturing tolerances. The brush roller 102 removes remainders 101 of the liquid ink by means of mechanical displacement, supported by the adhesion between the ink and the bristles and possibly by an electrostatic support. The basic body of the brush roller 102 is preferably composed of metal to which a voltage UR is applied in order to achieve the advantageous electrostatic separation effect. This voltage UR is a direct voltage that can be superposed with an alternating voltage. After contact with the photoconductor drum 12, the brush 103 passes through a bath 106 in a tank 100, which preferably contains carrier liquid of the ink in order to dissolve the remainders of the ink in this carrier liquid. Advantageously, for removing the residual ink from the brush 103, ultrasonic energy of an ultrasonic source 107 is applied to the area of contact between the brush and the carrier liquid. After leaving the bath 106, a suction device 104 acts on the brush 103 which device sucks off the residual liquid still adhering to the brush 103. The mixture of carrier liquid and residual ink present in the tank 100 can be treated and reused for the printing process.

The cleaning station 30 shown in FIG. 20 removes remainders 101 from the photoconductor drum 12. An identical or similarly structured cleaning station can also be used for cleaning the surface of an intermediate carrier, for example the intermediate carrier drum 14. Thus, in general, such a cleaning station can be used for removing residual ink that adheres to a carrier generally referred to as an image carrier, to which a liquid ink image has been applied.

Numerous modifications of the cleaning station are possible. For example, as shown in FIG. 20A, the cleaning station can include a removal roller 200 that is pressed against the surface of the image carrier 12. A doctor blade 201, which is arranged following the point of contact as viewed in the direction of rotation of the removal roller, serves to strip off the ink accepted by the removal roller. Preferably, the removal roller dips into a bath 202 with carrier liquid 203. After passing through the bath, a further doctor blade 204 can be arranged at the circumference of the removal roller in order to strip off the liquid at the surface of the removal roller. The surface energy of the surface of the removal roller should be set such that between the residual ink and the surface of the removal roller an adhesion is present that is higher than the cohesion within the residual ink. The cohesion within the residual ink should be greater than the adhesion between the residual ink and the surface of the image carrier.

Another embodiment of the cleaning station as shown in FIG. 20B comprises a cleaning fleece 210 that is pressed against the image carrier. Preferably, the cleaning fleece 210 is moved at a speed that is considerably lower than the circumferential speed of the image carrier. The cleaning fleece 210 can be designed as a continuous band 210A that, after contact with the surface of the image carrier is passed through a bath filled with carrier liquid 207. Thus, the ink is dissolved and removed from the cleaning fleece. A doctor blade 208 and preferably ultrasound 209 are applied to the continuous band. After leaving the bath, excess carrier liquid is removed from the continuous band, preferably with the aid of a pair of press rollers 205A, 205B.

Alternatively, the cleaning fleece can be rolled onto a supply roll 211 and is brought into contact with the surface of the image carrier with the aid of a roller 212 and a saddle 213. Subsequently, the cleaning fleece is wound up onto a take-up roll 214. The cleaning fleece is moved stepwise from the supply roll to the take-up roll. Between two steps, up to several thousands of sheets can be printed.

In a further alternative of the cleaning station as shown in FIG. 20, the station comprises a doctor blade 199 that is pressed against the image carrier. If the image carrier is present in the form of a band, a roller or a rod can be provided as a counter-bearing for the doctor blade.

In another embodiment of the cleaning station as shown in FIG. 20C, the station includes a splash bath device that directs a jet 215 of cleaning liquid onto the surface of the image carrier 12. The carrier liquid 216 of the ink is preferably used as a cleaning liquid.

Another alternative of the cleaning station includes a roller bath device that supplies cleaning liquid to the surface of the image carrier with the aid of a roller. This cleaning liquid, preferably the carrier liquid of the ink, dissolves the residual ink that is transported away upon rotation of the roller. A doctor blade, which strips off the dissolved liquid ink, then acts on the roller.

Another alternative of the cleaning station includes an air knife. It displaces the liquid ink from the image carrier to be cleaned. The displaced residual ink can be collected, treated and reused for the printing process.

Another embodiment of a cleaning station includes a suction device, which sucks the residual liquid ink from the surface of the image carrier. The sucked-off discharge air can be filtered and the liquid ink can be separated and is preferably reused in the further printing process.

As viewed in the direction of motion of the image carrier, as shown in FIG. 20 a dissolving station 217 can optionally be arranged before the cleaning station 30, said dissolving station applying a cleaning liquid 218 onto the surface of the image carrier 12. A scoop roller 219 can be provided for the application; alternatively, a section of the image carrier can pass through a bath with cleaning liquid. It is advantageous when the carrier liquid of the ink is used as the cleaning liquid. It is advantageous when an ultrasonic energy is applied to the point of contact between cleaning liquid and image carrier.

In the embodiment shown in FIG. 1, a regeneration station 32 is arranged following the cleaning station 30, as viewed in the direction of rotation of the photoconductor drum 12. While the cleaning station 30 guarantees a continuous mechanical cleaning, the regeneration station 32 serves to adjust and to permanently ensure defined process conditions, in particular with respect to the surface properties, such as the surface energy of the latent image carrier, the surface energy relation between the surface of the latent image carrier, the liquid ink and possibly the surface of intermediate carrier, as well as the surface roughness, i.e. the microscopic structure of the surface. Further, the regeneration station serves to adjust defined process conditions with regard to the electrical properties on the surface of the latent image carrier, for example with regard to the charge injection conditions and the surface resistance. Accordingly, the regeneration station determines the surface energy that controls the wettability of the surface with the liquid ink. For this purpose, the regeneration station applies a substance having an effect on the surface energy, preferably tenside solutions, in particular non-ionic tensides dissolved in water, onto the surface of the image carrier that can be an intermediate carrier or a latent image carrier. This substance can, for example, be applied with a layer thickness of less than 0.3 $\mu$m which completely wets the surface, preferably in a time less than 5 ms.

Further, the regeneration station can include a corona device that has a corona with an alternating voltage in the range of 1 to 20 kVpp (measured from peak to peak) at a frequency in the range of 1 to 10 kHz. This corona device can be used as an alternative with respect to the application of the substance or in combination together with the substance.

In a further alternative, the cleaning and the regeneration take place in a combined manner in one single operation. For example, the splash bath cleaning or a roller bath cleaning is used. For this purpose, a substance that controls the surface energy, preferably a tenside solution, is added to the cleaning liquid. This substance is then transferred onto the image carrier together with the cleaning liquid. Excess cleaning liquid can again be removed, with the possibility that such remainders are supplied to a recycling process.

Optionally, if cleaning is performed with a cleaning liquid and an added substance that controls the surface energy and after a regeneration has taken place, a drying of the surface of the image carrier by suitable means can take place, for example by means of a warm and dry air stream that is directed onto the surface. This drying serves to increase the surface-active components and as a result thereof to increase their effect. Moreover, a possibly disturbing effect of excess cleaning liquid is avoided.

In the following, photodielectric image generation processes are explained with the aid of which latent images can be generated on a photoconductor, which latent images can be inked by the liquid ink by overcoming the air gap. For this purpose, an image-wise distributed electric field is generated with the aid of the layer system of the photoconductor, the components of which electric field, in the space above the surface, exerting a force effect on charged particles, polarizable and conductive objects, i.e. for example on polarizable components of the ink liquid. The electric field distribution on the surface of the photoconductor is made visible during the development with the aid of the transferring liquid ink. The cleaning of the uppermost layer of the photoconductor that comes into contact with the ink has to be adapted to the particularities of the liquid ink. In addition to a cleaning of this surface and the establishment of a defined charge condition of the upper insulating cover layer of the photoconductor, the surface energy condition of this cover layer also has to be re-established or, respectively, maintained after each ink transfer change. Accordingly, the material of the upper insulating cover layer of the photoconductor has to be adapted to the use of aqueous ink. For inking the surface of the photoconductor, the surface energy conditions have to be such that in the latent image areas that are to be inked, the carrier liquid with the ink adheres to the surface. This adhesion requirement must at least be valid for the solid matter content of the ink. In the areas of the surface of the photoconductor that are not to be inked, the electrical repulsive effect has to predominate such that no liquid comes into contact with the insulating surface of the photoconductor.

In an alternative, due to the stability of the electric field above the insulating cover layer of the photoconductor, a permanent supply of the ink-containing liquid to this insulating layer can also take place, the polarity of the solid ink particles in the liquid having to be such that these particles are attracted by the electric field in the areas to be inked. In the areas that are not to be inked, the electric field direction is reversed so that charged solid ink particles are repelled.

An image-wise inking of the cover layer of the photoconductor can also be achieved in that the areas to be inked are wetted relatively well by the combined effect of the surface energy relation between the insulating cover layer and the liquid and the electric field, and the areas that are not to be inked are wetted relatively poorly as a result of the reversed field direction. This type of inking or the combination with the deposition of the charged solid ink particles is particularly suitable for the development process at high speed. In order to realize a high speed process with a pure particle deposition without substantial wetting differences between the areas that are to be inked and those that are not to be inked, the liquid layer has to be very thin and the concentration of the solid ink particles has to be relatively high. A particle charge as large as possible is advantageous for the high-speed development.

According to one embodiment, for a conventional photoconductor with an externally positioned photoconductive layer, this photoconductive layer can be provided with a thin insulating cover layer. This cover layer is selected such that it meets the requirements made to the wettability and to further surface properties, such as the charge injection property, for the acceptance and the release of liquid ink.

In FIGS. 21 to 26, photodielectric image generation processes are explained. For the latent image generation, a photodielectric process (FIGS. 21 and 22) can be used in which the formation of the latent image is controlled by an electric field in the photoconductor. Further, a charging current-controlled process can be used for the latent image generation (FIGS. 23 to 26).

Figure 21:
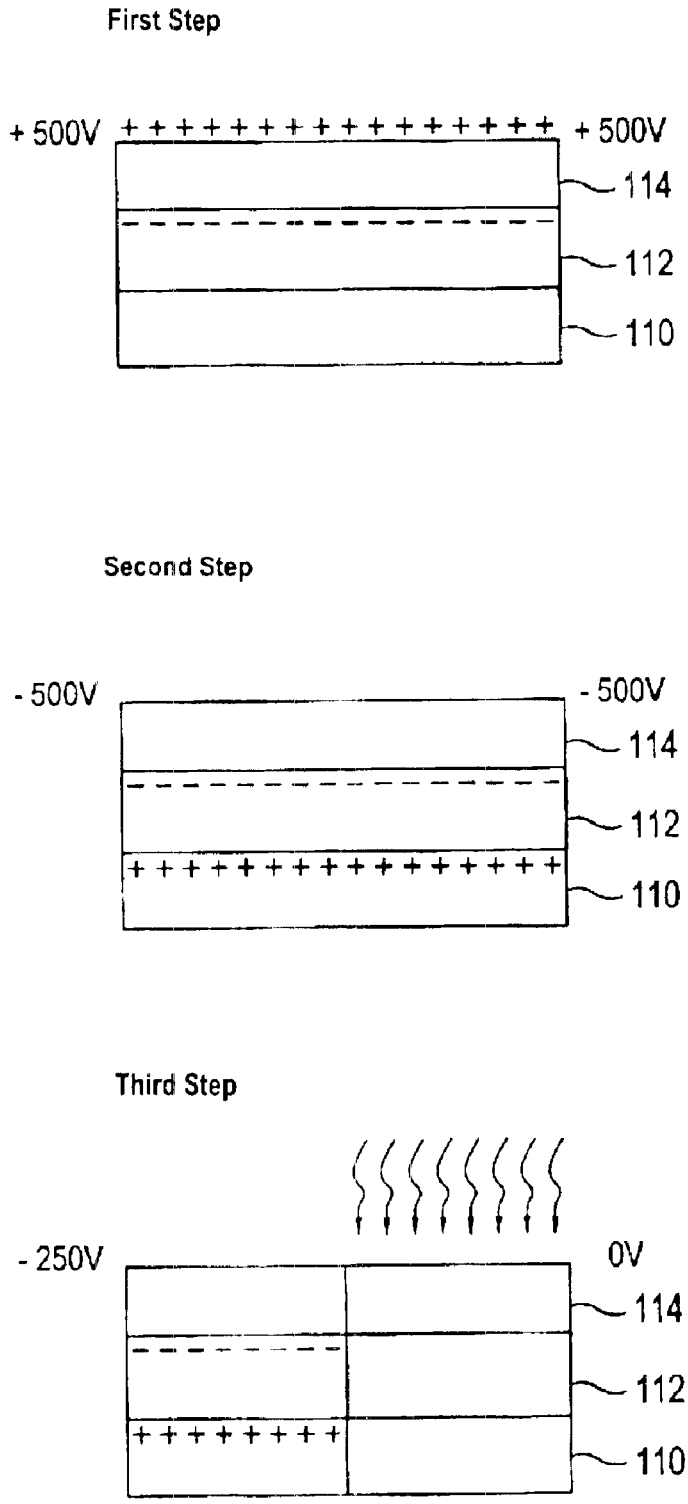
FIGS. 21 to 26 illustrate various photodielectric image generation processes for the generation of a latent image.

With reference to FIG. 21, an image generation process is explained that is also referred to as Nakamura process 1. The photoconductors shown in the following figures each have a lower conductive layer 110, a medium photosensitive layer 112 and an upper insulating cover layer 114. This cover layer 114 determines the surface energy condition, the electric surface resistance and the charge injection properties of the photoconductor. The cover layer 114 itself does not substantially influence the electrophotographic process for generating the latent image.

In the image generation process according to FIG. 21, the layer system of the photoconductor is, in a first step, first uniformly charged with one polarity, wherein the formation of an electric field in the photoconductor layer 112 is prevented by charge carrier injections from the lower conductive layer 110 into the photoconductor layer 112 and/or by simultaneous uniform exposure (not shown). Subsequently, the layer system is charge-reversed with the opposite polarity, an electric field being created in the photoconductor layer 112 (second step). In a third step, the layer system is exposed image-wise, the latent image being generated. Typical potential relations are entered in FIG. 21.

Figure 22:
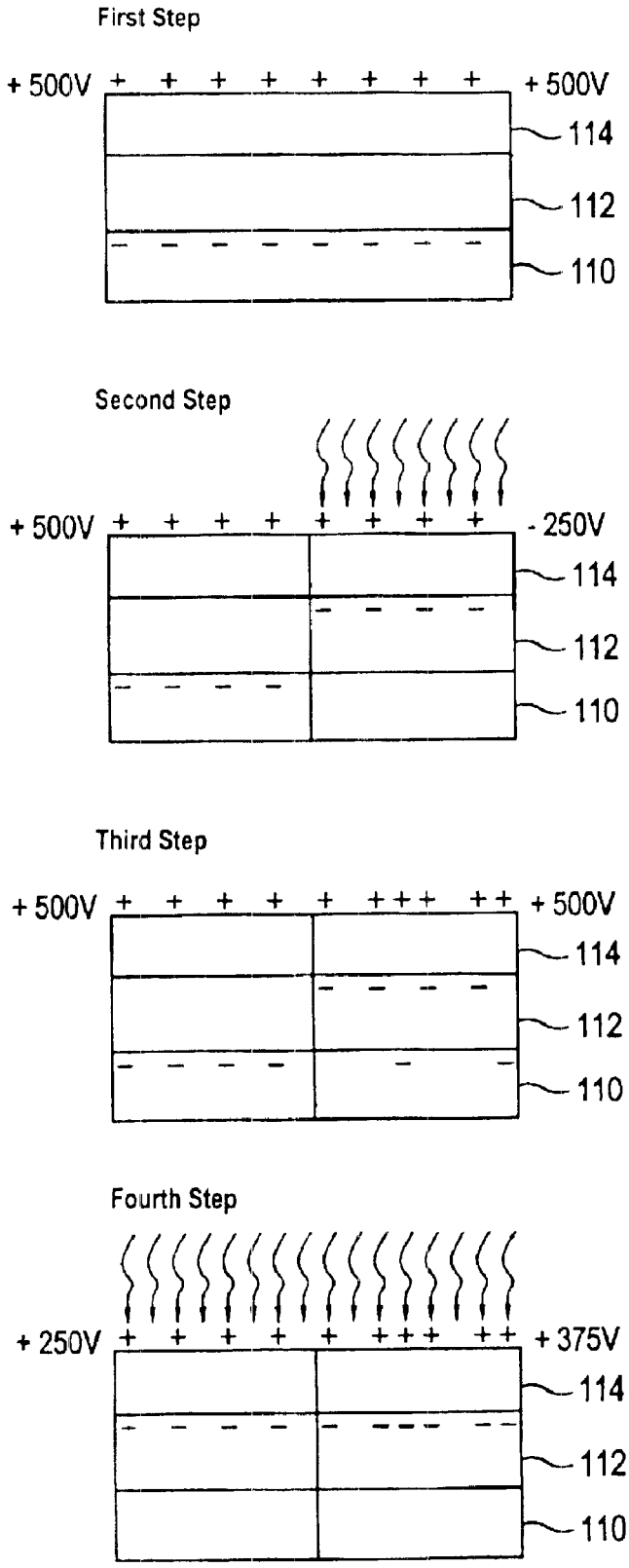

FIG. 22 relates to a photodielectric image generation process that is also referred to as a Hall process. In a first step, the layer system of the photoconductor is first uniformly charged with one polarity, an electric field being created in the photoconductor layer 112 as well as in the cover layer 114. Subsequently, the layer system is exposed image-wise (second step). As a result thereof, the electric field in the photoconductor layer 112 is removed in the exposed areas, while it is maintained in unexposed areas. In a third step, a new uniform charging with the same polarity as in the first step takes place. Subsequently, a uniform area exposure takes place, wherein the electric field is removed in all areas of the photoconductor layer 112 and the latent image is created (fourth step). In FIG. 22, typical potential conditions are again entered.

Figure 23:
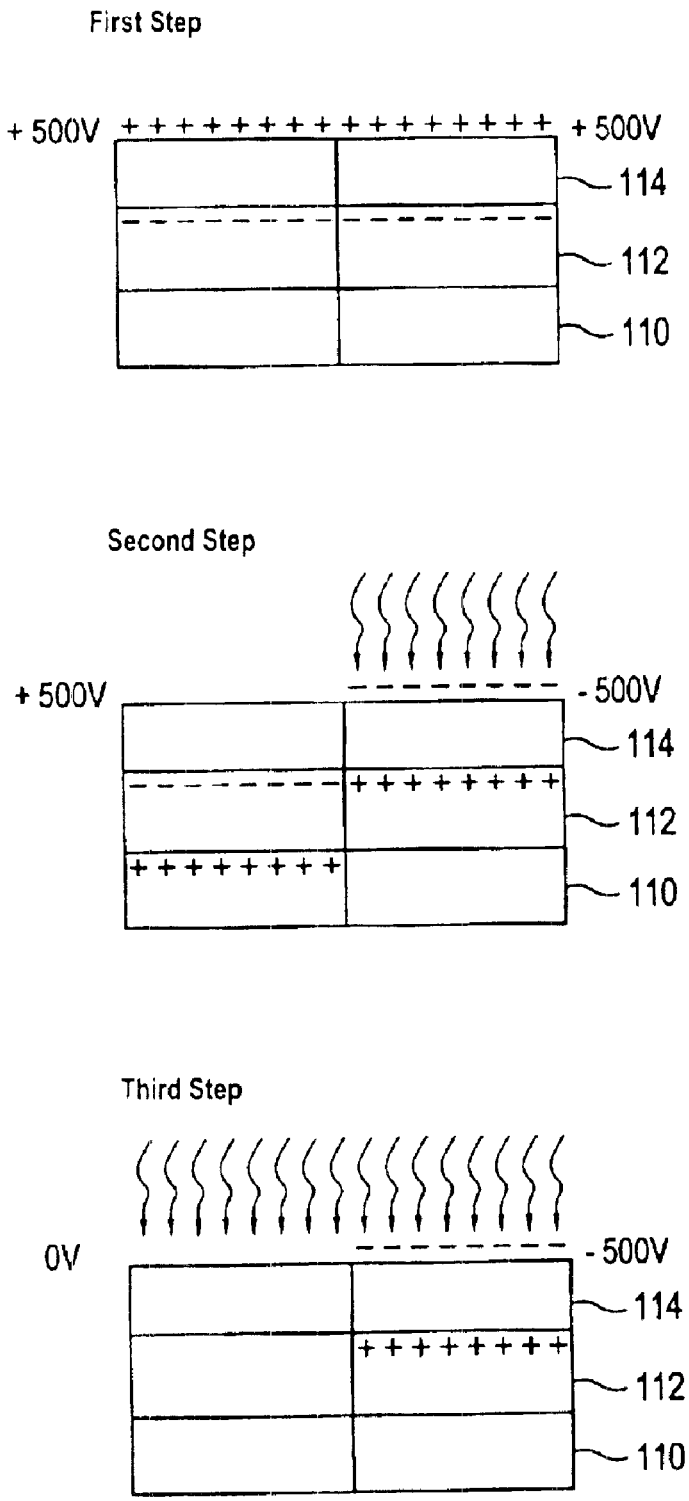

FIG. 23 shows a photodielectric image generation process that is also referred to as a Katsuragawa process, a charging current-controlled process being employed for the latent image generation. In a first step, the layer system of the photoconductor is first uniformly charged with one polarity, wherein the creation of an electric field in the photoconductor layer 112 is prevented by means of charge carrier injection from the lower conductive layer 110 into the photoconductor layer 112 and/or by simultaneous uniform exposure (not shown). In a second step, the layer system is exposed image-wise and, at the same time, is charge-reversed with a polarity that is opposite to the charging in the first step, the creation of an electric field in the photoconductor layer 112 being prevented in the exposed areas. In the unexposed areas, an electric field is created in the photoconductor layer 112. In a third step, the layer system is uniformly exposed, the latent image being created. In FIG. 23, too, typical potential conditions are entered.

Figure 24:
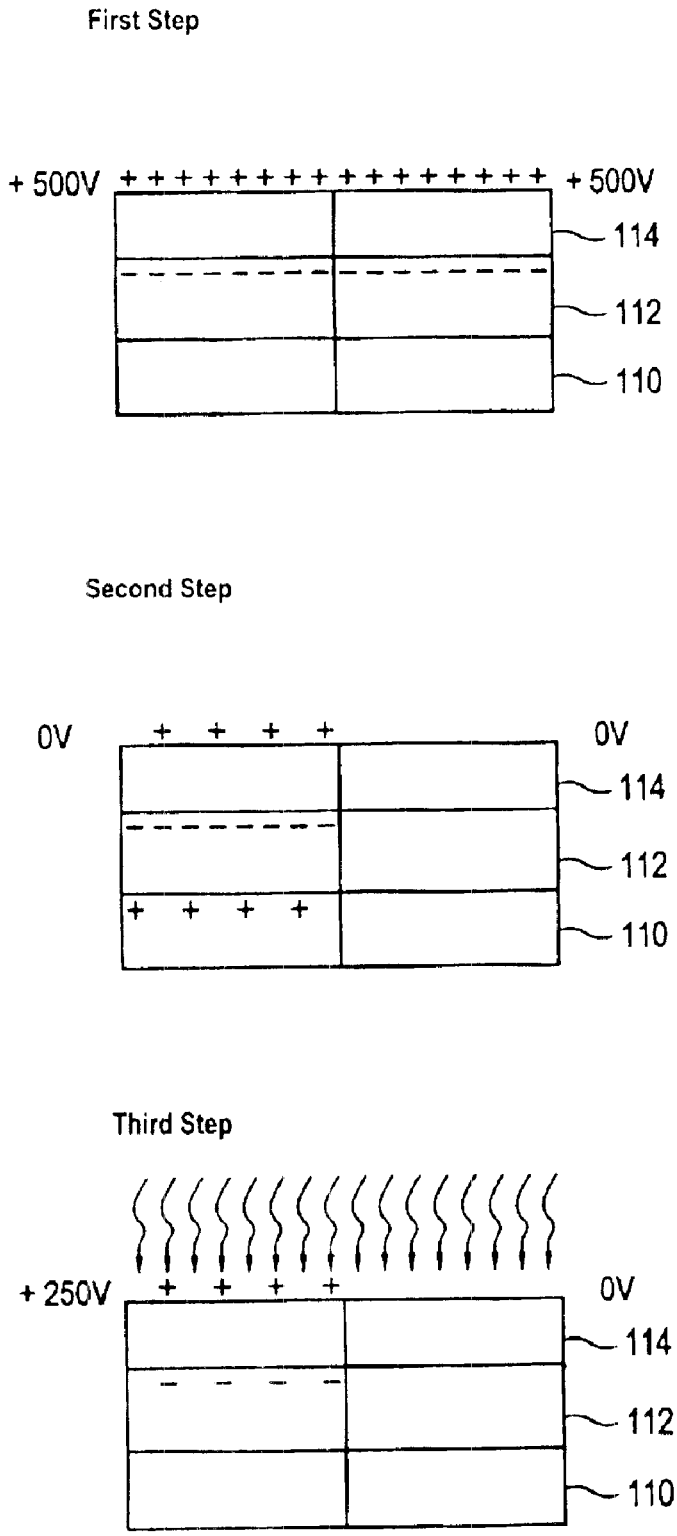

In FIG. 24, a further charging current-controlled image generation process is described, this process being referred to as a Canon-NP-process. In a first step, the layer system of the photoconductor is first uniformly charged with one polarity, wherein the creation of an electric field in the photoconductor layer 112 is prevented by means of charge carrier injection from the lower conductive layer 110 into the photoconductor layer 112 and/or by simultaneous uniform exposure (not shown). Subsequently, the layer system is exposed image-wise and, at the same time, preferably with the aid of an alternating current corona, discharged, the creation of an electric field in the photoconductor layer 112 being prevented in exposed areas. In unexposed areas, an electric field is created in the photoconductor layer 112 (second step). In a third step, the layer system is uniformly exposed, the latent image being created. In FIG. 24, typical potential conditions are again entered.

Figure 25:
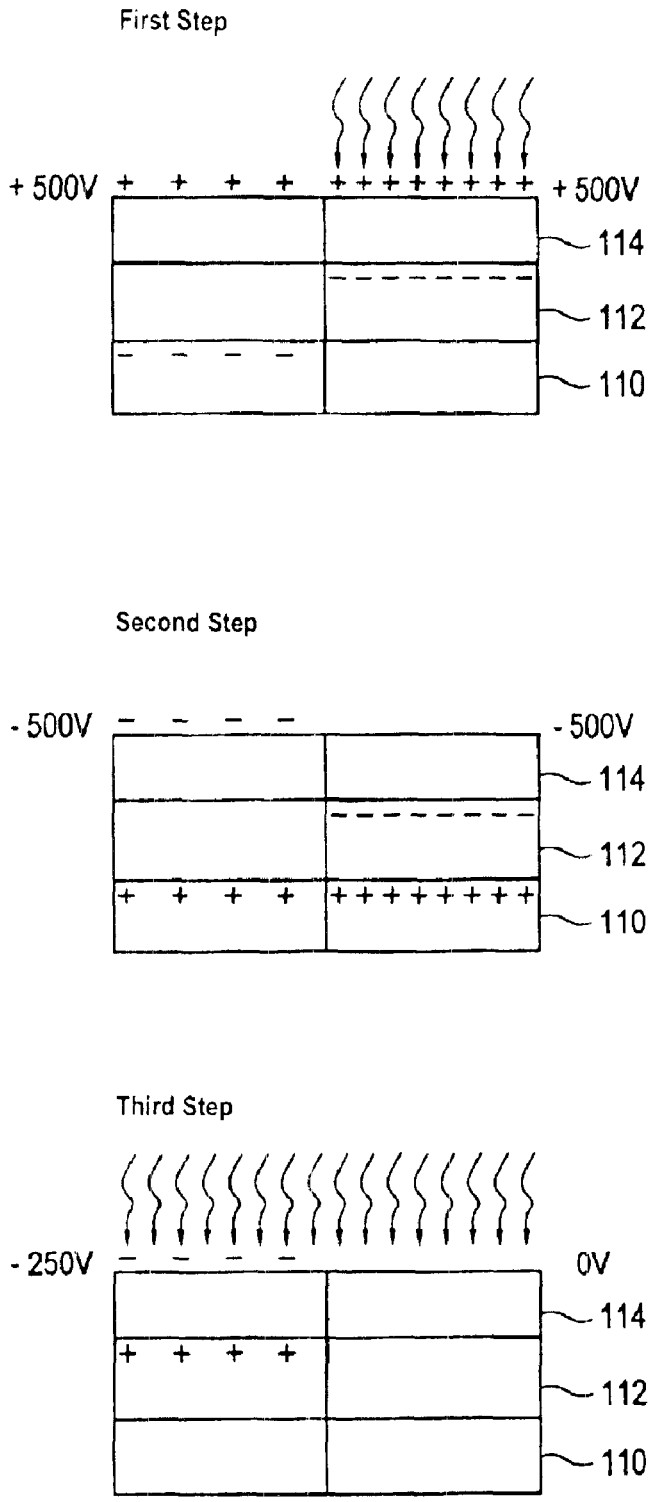

FIG. 25 describes a charging current-controlled image generation process that is referred to as a Nakamura process 3. In a first step, the layer system is uniformly charged with one polarity (in the example of FIG. 25, the positive polarity has been chosen) and, at the same time, exposed image-wise. The creation of an electric field in the photoconductor layer 112 is prevented in exposed areas, while a somewhat smaller electric field is created in the photoconductor layer 112 as well as in the cover layer 114 in unexposed areas. Subsequently, in a second step, a uniform charge reversal with a polarity that is opposite to the charging in the first step takes place. Then, the surface potential is of the same magnitude in areas that have been exposed and not exposed in the first step, in the example according to FIG. 25 about −500 Volt. The latent image is created during the final uniform exposure of the entire layer system (third step) Again, typical potential conditions are entered in FIG. 25.

Figure 26:
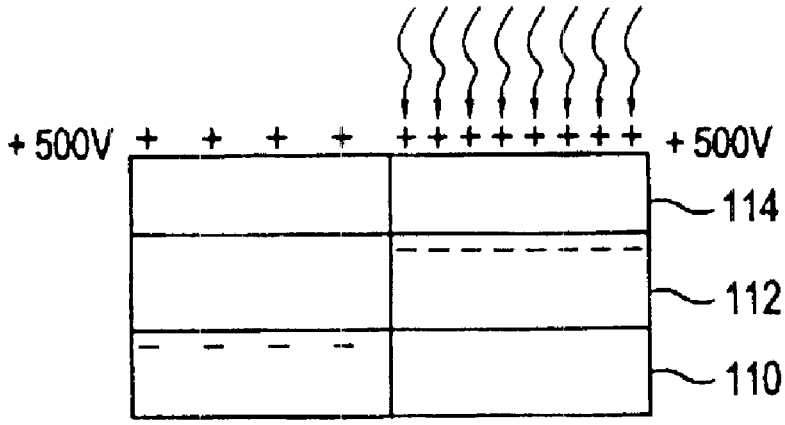
Figure 26:
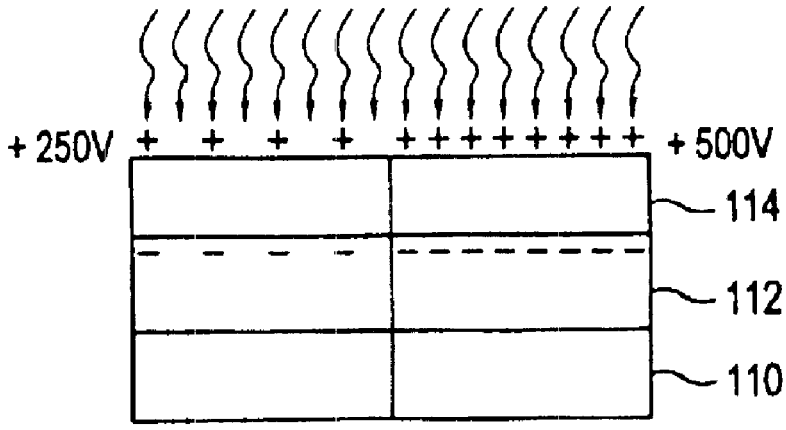

FIG. 26 shows a charging current-controlled image generation process that is referred to as a Simac process. In a first step, the layer system is uniformly charged with one polarity (in the example according to FIG. 26 positively) and, at the same time, exposed image-wise. The creation of an electric field in the photoconductor layer 112 is prevented in exposed areas, while a somewhat smaller electric field is created in unexposed areas in the photoconductor layer 112 as well as in the cover layer 114. The latent image is created in the second step during the subsequent uniform exposure of the entire layer system, the electric field being removed in all areas of the photoconductor layer. In FIG. 26, too, typical potential conditions are entered.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

What is claimed is:

1. A device for regenerating a surface of an image carrier of an electrographic printer or copier, comprising:

a regenerating station arranged at a circumference of the image carrier and generating defined surface properties on the surface of the image carrier such that the surface accepts and again gives off a liquid ink; and the regeneration station applies a surface energy-influencing substance to the surface of the image carrier.

2. The device according to claim 1 wherein the surface energy-influencing substance is applied with a layer thickness of <0.3 $\mu$m, which totally wets the surface.

3. A device for regenerating a surface of an image carrier of an electrographic printer or copier, comprising:

a regenerating station arranged at a circumference of the image carrier and generating defined surface properties on the surface of the image carrier such that the surface accepts and again gives off a liquid ink; and the regeneration station includes a corona device that has a corona with an alternating voltage in a range of 1 to 20 kVpp at a frequency in a range of 1 to 10 kHz.

4. A device for regenerating a surface of an image carrier of an electrographic printer or copier, comprising:

a regenerating station arranged at a circumference of the image carrier and generating defined surface properties on the surface of the image carrier such that the surface accepts and again gives off a liquid ink; and the image carrier is dried by a drying station after passing through the regeneration station.

5. A regenerating station arranged at a circumference of the image carrier and generating defined surface properties on the surface of the image carrier such that the surface accepts and again gives off a liquid ink; and in addition to the regeneration station, a cleaning station is arranged at the circumference of the image carrier, said cleaning station removing residual ink remaining after transfer of an image inked with the liquid ink from the surface of the image carrier.

6. The device according to claim 5 wherein the cleaning and the regeneration of the surface properties of the image carrier are performed in a common step.

7. The device according to claim 6 wherein for cleaning and for regenerating the surface properties of the image carrier in said common step, a substance is used that absorbs the residual ink from the surface of the image carrier, and contains substances that generate the surface properties of the image carrier in a defined way.

8. The device according to claim 5 wherein the cleaning station includes a brush roller having a brush which is in contact with the surface of the image carrier and removes the ink.

9. The device according to claim 8 wherein for removing the residual ink from the brush, ultrasonic energy is applied to a contact area between the brush and a carrier liquid.

10. The device according to claim 8 wherein ultrasonic energy is applied to a point of contact between a cleaning liquid and the brush roller.

11. The device according to claim 5 wherein the cleaning station comprises a removal roller which is pressed against the surface of the image carrier and following a point of contact as viewed in a direction of rotation of the removal roller, a doctor blade for stripping off the ink accepted by the removal roller being arranged at the removal roller.

12. The device according to claim 11 wherein the removal roller dips into a bath with carrier liquid, and after passing through the bath a further doctor blade is arranged at a circumference of the removal roller.

13. The device according to claim 11 wherein the surface energy of the surface of the removal roller is chosen such that between the residual ink and a surface of the removal roller an adhesion is present that is higher than cohesion within the residual ink, and the cohesion within the residual ink is being greater than an adhesion between the residual ink and the surface of the image carrier.

14. The device according to claim 5 wherein the cleaning station includes a cleaning fleece that is pressed against the image carrier.

15. The device according to claim 14 wherein the cleaning fleece is moved at a considerably lower speed than a circumferential speed of the image carrier.

16. The device according to claim 14 wherein the fleece is wound up onto a supply roll, is brought into contact with the surface of the image carrier with the aid of at least one of a roller and a saddle, and subsequently is wound up onto a take-up roll.

17. The device according to claim 16 wherein the fleece is moved step-wise from the supply roll to the take-up roll.

18. The device according to claim 14 wherein the fleece is formed as a continuous band, and after contact with the surface of the image carrier, it is guided through a bath filled with the carrier liquid, and the absorbed ink is dissolved and removed.

19. The device according to claim 18 wherein a doctor blade is applied to the continuous band, and, after leaving the bath, excess carrier liquid is removed from the continuous band.

20. The device according to claim 5 wherein the cleaning station includes a doctor blade that is pressed against the image carrier.

21. The device according to claim 5 wherein the cleaning station includes a splash bath device that directs a jet of cleaning liquid onto the surface of the image carrier.

22. The device according to claim 21 wherein a carrier liquid of the ink is used as a cleaning liquid.

23. The device according to claim 5 wherein, as viewed in a direction of motion of the image carrier, a dissolving station is arranged before the cleaning station, said dissolving station applying a cleaning liquid to the surface of the image carrier.

24. The device according to claim 23 wherein a scoop roller is provided for the application.

25. The device according to claim 24 wherein a carrier liquid of the ink is used as the cleaning liquid.

26. A method for regenerating a surface of an image carrier of an electro ra hic printer or copier, comprising the steps of:

generating defined surface properties on the surface of the image carrier by a regeneration station arranged at a circumference of the image carrier such that the surface accepts and again gives off a liquid ink; and the regeneration station applies a surface energy-influencing substance to the surface of the image carrier.

27. The method according to claim 26 wherein the surface energy-influencing substance is applied with a layer thickness of <0.3 $\mu$m, which totally wets the surface.

28. A method for regenerating a surface of an image carrier of an electrographic printer or copier, comprising the steps of:

generating defined surface properties on the surface of the image carrier by a regeneration station arranged at a circumference of the image carrier such that the surface accepts and again gives off a liquid ink; and the regeneration station includes a corona device that has a corona with an alternating voltage in a range of 1 to 20 kVpp at a frequency in a range of 1 to 10 kHz.

29. A method for regenerating a surface of an image carrier of an electro graphic printer or copier, comprising the steps of:

generating defined surface properties on the surface of the image carrier by a regeneration station arranged at a circumference of the image carrier such that the surface accepts and again gives off a liquid ink; and a cleaning station is provided and a cleaning liquid thereof contains a surface energy-influencing substance.

30. A method for regenerating a surface of an image carrier of an electrographic printer or copier, comprising the steps of:

generating defined surface properties on the surface of the image carrier by a regeneration station arranged at a circumference of the image carrier such that the surface accepts and again gives off a liquid ink; and the image carrier is dried after passing through the regeneration station.

31. A method for regenerating a surface of an image carrier of an electrographic printer or copier, comprising the steps of:

generating defined surface properties on the surface of the image carrier by a regeneration station arranged at a circumference of the image carrier such that the surface accepts and again gives off a liquid ink; and a cleaning station is arranged in a region of the image carrier in addition to the regeneration station, and which removes the residual ink remaining after transfer of the image inked with a liquid ink from the surface of the image carrier.

32. A device for cleaning an image carrier of ink image remainders of an electrographic printer or copier, comprising:

a latent image carrier with a potential pattern corresponding to an image pattern to be printed;

an applicator element having a liquid layer of ink;

an air gap between the liquid layer and a surface of the latent image carrier that is opposed thereto;

droplets transferred from the liquid layer onto the surface of the latent image carrier by overcoming the air gap for inking the latent image on the latent image carrier;

a cleaning station at a circumference of the image carrier and which removes residual ink remaining after transfer of the image inked with the liquid ink from the surface of the image carrier; and as viewed in a direction of motion of the image carrier, a dissolving station arranged before the cleaning station, said dissolving station applying a cleaning liquid to the surface of the image carrier.

33. The device according to claim 32 wherein a scoop roller is provided for the application of the cleaning liquid, and a portion of the image carrier passing through a bath with the cleaning liquid.

34. The device according to claim 32 wherein a carrier liquid of the ink is used as the cleaning liquid.

35. The device according to claim 32 wherein ultrasonic energy is applied to a point of contact between the cleaning liquid and a brush roller of the cleaning station.

36. A method for cleaning an image carrier of ink image remainders of an electrographic printer or copier, comprising the steps of:

providing a latent image carrier with a potential pattern corresponding to an image pattern to be printed;

providing an applicator element with a liquid layer of ink;

providing an air gap between the liquid layer and a surface of the latent image carrier opposed thereto;

arranging a cleaning station at a circumference of the image carrier;

as viewed in a direction of motion of the image carrier, arranging a dissolving station before the cleaning station;

for inking the latent image on the latent image carrier, transferring droplets from the liquid layer onto the surface of the latent image carrier by overcoming the air gap;

applying a cleaning liquid to the surface of the image carrier with the dissolving station; and removing residual ink remaining after transfer of the image inked with the liquid ink from the surface of the image carrier with the cleaning station.

37. The method according to claim 36 wherein the cleaning station includes a brush roller having a brush which is in contact with the surface of the image carrier and removes the residual ink.

38. The method according to claim 37 wherein, following the contact with the image carrier, the brush passes through a bath which includes a carrier liquid of the ink in order to dissolve remainders of the ink in the carrier liquid.

39. The method according to claim 38 wherein liquid remainders still adhering to the brush after it has left the bath with carrier liquid are sucked off by a suction device.

40. The method according to claim 37 wherein for removing the residual ink from the brush, ultrasonic energy is applied to a contact area between the brush and a carrier liquid of the ink.

41. The method according to claim 36 wherein remainders of the ink dissolved in a carrier liquid of the ink are reused for a printing process.

42. The method according to claim 36 wherein the cleaning station comprises a removal roller pressed against the surface of the image carrier, and following a point of contact as viewed in a direction of rotation of the removal roller, arranging a doctor blade for stripping off the ink accepted by the removal roller.

43. The method according to claim 42 wherein the removal roller dips into a bath with a carrier liquid of the ink, and after passing through the bath providing a further doctor blade at a circumference of the removal roller.

44. The method according to claim 42 wherein a surface energy of a surface of the removal roller is chosen such that between the residual ink and the surface of the removal roller an adhesion is present that is higher than a cohesion within the residual ink, and the cohesion within the residual ink is greater than an adhesion between the residual ink and the surface of the image carrier.

45. The method according to claim 36 wherein the cleaning station includes a cleaning fleece that is pressed against the image carrier.

46. The method according to claim 45 wherein the cleaning fleece is moved at a considerably lower speed than a circumferential speed of the image carrier.

47. A method for regenerating a surface of an image carrier of an electrographic printer or copier, comprising the steps of:

generating defined surface properties on the surface of the image carrier by a regeneration station arranged at a circumference of the image carrier such that the surface accepts and again gives off a liquid ink, the regeneration station applying a surface energy-influencing substance to the surface of the image carrier; and arranging a cleaning station in a region of the image carrier in addition to the regeneration station, and which removes residual ink remaining after transfer of the image inked with a liquid ink from the surface of the image carrier.

* * * * *